US007455504B2

(12) United States Patent
Hill et al.

(10) Patent No.: US 7,455,504 B2
(45) Date of Patent: Nov. 25, 2008

(54) HIGH EFFICIENCY FLUID MOVERS

(75) Inventors: Charles C. Hill, Del Mar, CA (US); Theodore B. Hill, San Diego, CA (US)

(73) Assignee: Hill Engineering, San Diego, CA (US)

( * ) Notice: Subject to any disclaimer, the term of this patent is extended or adjusted under 35 U.S.C. 154(b) by 212 days.

(21) Appl. No.: 11/335,284

(22) Filed: Jan. 19, 2006

(65) Prior Publication Data

US 2007/0116561 A1 May 24, 2007

Related U.S. Application Data

(60) Provisional application No. 60/739,316, filed on Nov. 23, 2005.

(51) Int. Cl.
*F04D 29/44* (2006.01)

(52) U.S. Cl. ..... 416/179; 416/229 R; 416/231 R

(58) Field of Classification Search ..... 415/90, 415/98, 119, 121.1, 121.2, 200, 203; 416/178, 416/229 R, 230, 231 R, 237
See application file for complete search history.

(56) References Cited

U.S. PATENT DOCUMENTS

| | | | | |
|---|---|---|---|---|
| 963,277 | A * | 7/1910 | Clifford | 415/198.1 |
| 1,013,248 | A | 1/1912 | Wilkinson | |
| 1,061,142 | A | 5/1913 | Tesla | |
| 1,061,206 | A | 5/1913 | Telsa | |
| 2,632,598 | A | 3/1953 | Wales | |
| 2,956,503 | A | 10/1960 | Neidl | |
| 3,190,544 | A * | 6/1965 | McDonald | 416/218 |
| 3,734,640 | A | 5/1973 | Daniel | |
| 3,864,055 | A | 2/1975 | Kletschka et al. | |
| 4,255,081 | A | 3/1981 | Oklejas et al. | |
| 4,402,647 | A | 9/1983 | Effenberger | |
| 4,531,890 | A | 7/1985 | Stokes | |
| 4,652,207 | A | 3/1987 | Brown et al. | |
| 4,795,319 | A * | 1/1989 | Popovich et al. | 417/354 |

(Continued)

FOREIGN PATENT DOCUMENTS

| | | |
|---|---|---|
| EP | 0474929 | 3/1992 |

OTHER PUBLICATIONS

Grimes et al., "Scaling the Performance of Micro-Fans", Proceedings of ICMM2003 Microchannels and Minichannels, (2003) pp. 1-8.

(Continued)

*Primary Examiner*—Igor Kershteyn
(74) *Attorney, Agent, or Firm*—Knobbe Martens Olson & Bear LLP

(57) ABSTRACT

Fluid movers produce at least predominantly laminar flow internally in an axial or a radial direction in a rotor. A fluid mover rotor comprises a matrix of passages of appropriate size to produce at least predominantly laminar flow spaced circumferentially around the rotor. The passages may provide axial, radial or mixed flow. "Appropriate" dimensions may be selected for a specified volume flow rate. In a radial embodiment, a matrix of radially extending passages could comprise walls having an axial height projecting from an annular disk. The passages may be offset with respect to the radial direction to provide an angle of attack that minimizes incidence losses. The matrix structure allows the use of thin-walled passages to minimize blockage of entering air.

22 Claims, 17 Drawing Sheets

U.S. PATENT DOCUMENTS

| | | | | |
|---|---|---|---|---|
| 5,165,846 | A | 11/1992 | Possell | |
| 5,192,182 | A | 3/1993 | Possell | |
| 5,192,183 | A | 3/1993 | Wilkinson | |
| 5,257,902 | A | 11/1993 | Atarashi et al. | |
| 5,265,348 | A * | 11/1993 | Fleishman et al. | 34/97 |
| 5,292,479 | A | 3/1994 | Haraga et al. | |
| 5,297,926 | A | 3/1994 | Negishi | |
| 5,419,679 | A | 5/1995 | Gaunt et al. | |
| 5,427,503 | A | 6/1995 | Haraga et al. | |
| 5,707,205 | A | 1/1998 | Otsuka | |
| 5,741,118 | A | 4/1998 | Shinbara et al. | |
| 5,961,289 | A | 10/1999 | Lohmann | |
| 6,010,666 | A | 1/2000 | Kurokawa et al. | |
| 6,050,772 | A | 4/2000 | Hatakeyama et al. | |
| 6,099,608 | A | 8/2000 | Harms et al. | |
| 6,099,609 | A | 8/2000 | Lira et al. | |
| 6,132,171 | A | 10/2000 | Fujinaka et al. | |
| 6,183,641 | B1 | 2/2001 | Conrad et al. | |
| 6,210,116 | B1 | 4/2001 | Kuczaj | |
| 6,227,796 | B1 | 5/2001 | Markovitch | |
| 6,277,176 | B1 | 8/2001 | Tang et al. | |
| 6,348,086 | B1 * | 2/2002 | Harms et al. | 96/125 |
| 6,368,078 | B1 | 4/2002 | Palumbo | |
| 6,375,412 | B1 | 4/2002 | Dial | |
| 6,422,307 | B1 | 7/2002 | Bhatti et al. | |
| 6,503,067 | B2 | 1/2003 | Palumbo | |
| 6,692,229 | B2 | 2/2004 | Metz | |
| 2004/0184914 | A1 | 9/2004 | Doege et al. | |
| 2005/0042082 | A1 | 2/2005 | Tamagawa et al. | |

OTHER PUBLICATIONS

Quin et al., "The Effect of Reynolds Number on Microfan Performance", Proceedings of ICMM2004, The 2nd International Conference on Microchannels and Minichannels, (2004), pp. 1-8.

International Preliminary Report on Patentability dated Feb. 26, 2008.

* cited by examiner

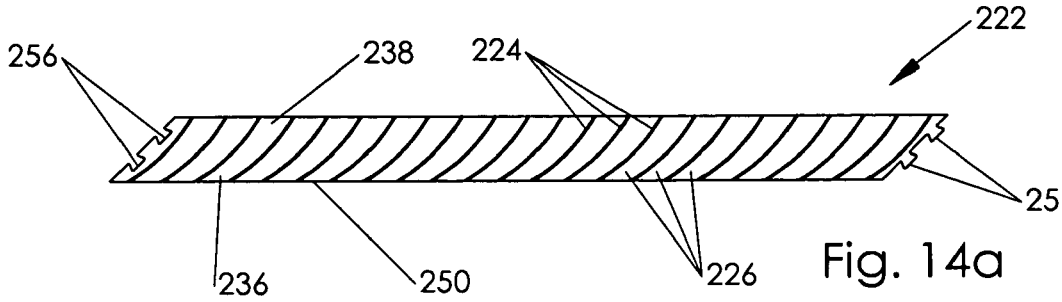
Fig. 14a
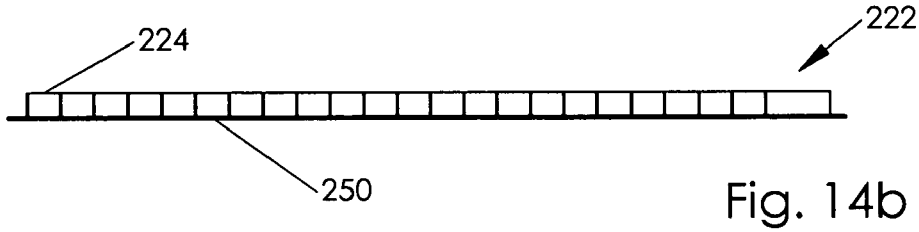
Fig. 14b
Fig. 15a
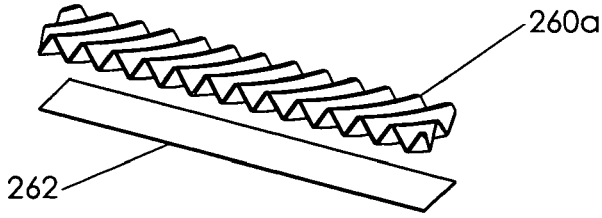
Fig. 15b
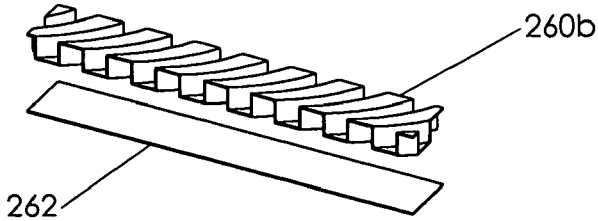
Fig. 15c
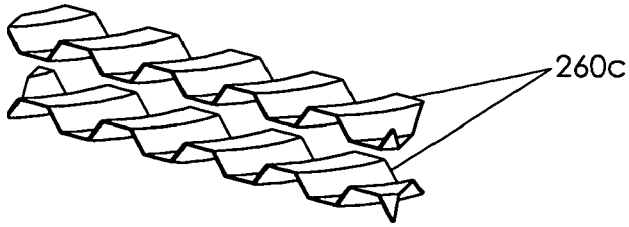

HIGH EFFICIENCY FLUID MOVERS

CROSS REFERENCE TO RELATED APPLICATIONS

This application claims priority to U.S. Provisional Application 60/739,316, filed on Nov. 23, 2005.

BACKGROUND OF THE INVENTION

1. Field of the Invention

The subject of the present invention relates to fluid-moving turbomachinery.

2. Description of the Related Art

Turbomachinery comprises rotating, fluid flow dynamic devices for transferring momentum into or out of the flowing fluid. The present subject matter relates to turbines driven by moving fluid as well as powered rotors which move fluid. Often, the fluid under consideration will be air. However, the considerations discussed here and below apply to other fluids, and are not limited to air. Other fluids include liquids and gases other than air. Commonly, machines providing outflow in the axial direction, i.e., along the axis of rotation of the rotor, are referred to as fans. Machines providing radial flow, i.e., at right angles to the axis of rotation of the rotor, are referred to as blowers. In certain forms of machines, fan or blower rotating elements are referred to as rotors. In the present description, fans, blowers, rotors, and associated functional components are referred to collectively as fluid movers.

A significant application of prior art axial and radial flow fluid movers is the cooling of electronic components, particularly semiconductor processors and other circuits. It is desirable to provide small air moving machines for producing flow over semiconductor components or over heat sinks, heat pipes or other heat transfer components that are thermally connected to semiconductors. Small air moving machines in the present context refer to the sorts of machines used to cool electronics and which can fit, for example, in laptop computers. This description is used in contrast to large machines of the type used, for example, in industrial heat exchangers or other machines mounted in enclosures which do not have particular size constraints.

Experience has shown that effective fan and blower designs for large machines which are proportionately scaled down to produce a small machine to fit in a laptop computer suffer large decreases in efficiency. This experience is reported, for example, by Quin, D. et al., The Effect of Reynolds Number on Microfan Performance, Proceedings of the 2nd International Conference on Microchannels and Minichannels, June 2004. This is very problematic in small portable electronic equipment because battery life is reduced by fan or blower operation. Thus, turbomachinery that can be made small in size and more efficient than conventional turbomachinery is highly desired in the art.

SUMMARY OF THE INVENTION

In one embodiment, the invention comprises a rotor to transfer momentum with a fluid when operating at a pre-selected volumetric flow rate through the rotor. The rotor comprises a plurality of enclosed passages formed in the rotor for transferring momentum into or out of the fluid as the fluid passes through the enclosed passages in response to rotation of the rotor. The passages are formed with a cross sectional shape and cross sectional dimensions along their entire length sufficient to establish and maintain laminar flow of the fluid along the entire length of the enclosed passages when the fluid is passing through the rotor at the pre-selected volumetric flow rate.

In another embodiment, a method of making a fluid mover is provided. This method comprises defining an operating volumetric flow rate Q and defining one or both of an open fluid inlet area $A_1$ and an open fluid outlet area $A_2$. A range of fluid flow passage characteristic cross sectional dimensions D are determined in accordance with the relationship $200(A\nu/Q)<D<2300(A\nu/Q)$, where $\nu$ is the kinematic viscosity of the fluid, and A is the smaller of $A_1$ and $A_2$. A rotor is produced comprising a plurality of fluid flow passages, wherein substantially all the fluid flow passages have a characteristic cross sectional dimension at all points along their length within the determined range of characteristic cross sectional dimensions.

In another embodiment, a fluid mover comprises a rotor coupled to a motor for rotational motion around an axis. Enclosed passages extend through the rotor, wherein the passages have a characteristic cross sectional dimension at all points along their length defined by $200(A\nu/Q)<D<2300(A\nu/Q)$, where $\nu$ is the kinematic viscosity of the fluid moved by the rotor, Q is a volumetric flow rate of the fluid moved by the rotor, and A is the smaller of $A_1$ and $A_2$.

In another embodiment, a method of cooling one or more electronic circuits comprises forcing air to flow through a plurality of passages such that the flow is characterized by a Reynolds number through the passages of between 200 and 2300, and directing the air toward the electronic circuits and/or toward heat dissipating components thermally coupled to the electronic circuits.

In another embodiment, a cooling fan comprises a rotor coupled to a motor for rotational motion around an axis, the rotor having a diameter of less than or equal to about 100 mm, the rotor defining an open air inlet area $A_1$ and an open air outlet area $A_2$, wherein $A_1$ and $A_2$ are both equal to or less than about 5000 $mm^2$. A plurality of enclosed passages extend through the rotor, wherein the passages have a maximum hydraulic diameter $D_h$ along their length within a range defined by $200(A\nu/Q)<D_h<2300(A\nu/Q)$, where $\nu$ is the kinematic viscosity of air, Q is a pre-selected volumetric flow rate of air through the rotor, and A is the smaller of $A_1$ and $A_2$. The passages also have a ratio of maximum cross sectional dimension to minimum cross sectional dimension of about 1.0 to about 3.0, and a length of at least about $3D_h$.

In another embodiment, a cooling fan comprises a rotor coupled to a motor for rotational motion around an axis, the rotor having a diameter of less than or equal to about 100 mm. A plurality of enclosed passages extend through the rotor. The passages have, a maximum cross sectional dimension along the length of the passages of between 0.5 mm and 5 mm, and a minimum cross sectional dimension of at least ⅓ of the maximum cross sectional dimension.

In another embodiment, a portable electronic device comprises a battery and heat generating electronic circuits powered by the battery. A cooling fan is also powered by the battery and is positioned to cool the electronic devices. The cooling fan comprises a rotor coupled to a motor for rotational motion around an axis. The rotor has a diameter of less than or equal to about 50 mm, and defines an open air inlet area $A_1$ and an open air outlet area $A_2$, wherein $A_1$ and $A_2$ are both equal to or less than about 5000 $mm^2$. A plurality of enclosed passages extend through the rotor. The passages have a maximum hydraulic diameter $D_h$ along their length within the range defined by $200(A\nu/Q)<D_h<2300(A\nu/Q)$, where $\nu$ is the kinematic viscosity of air, Q is a selected volumetric flow rate of the air, and A is the smaller of $A_1$ and $A_2$. Also, the passages have a ratio of maximum cross sectional dimension to minimum cross sectional dimension of between about 1.0 and about 3.0, and a length of at least about $3D_h$.

In another embodiment, a portable electronic device comprises a battery and heat generating electronic circuits powered by the battery. A cooling fan is also powered by the battery and is positioned to cool the electronic devices. The cooling fan comprises a rotor coupled to a motor for rotational motion around an axis. A plurality of enclosed passages extend through the rotor. The passages have a maximum cross sectional dimension along the length of the passages of between 0.5 mm and 5 mm, and a minimum cross sectional dimension of at least ⅓ of the maximum cross sectional dimension.

In another embodiment, a rotor for transferring momentum to or from a fluid in response to rotor rotation comprises a rigid, self-reinforcing, stacked matrix of passages having first ends distributed over a fluid inlet surface of the rotor. The first ends of the passages defining an open cross sectional area for fluid flow that is at least 70% of the fluid inlet surface.

In another embodiment, a stator for increasing static pressure in a fluid mover comprises a rigid, self-reinforcing, stacked matrix of passages having first ends distributed over a fluid inlet surface of the stator, the first ends of the passages defining an open cross sectional area for fluid flow that is at least 70% of the fluid inlet surface.

In another embodiment, a fluid mover comprises a rotor coupled to a motor for rotational motion around an axis and enclosed passages extending through the rotor. Substantially all of the passages have maximum and minimum cross sectional dimensions at all points along their length defined by $1.0 \leqq D_{max}/D_{min} \leqq 3.0$ and $250(A\nu/Q) < D_{max} < 5000(A\nu/Q)$, where $\nu$ is the kinematic viscosity of the fluid moved by the rotor, Q is a volumetric flow rate of the fluid moved by the rotor, and A is the smaller of $A_1$ and $A_2$.

This summary is not exhaustive, nor is it determinative of the scope of the invention.

BRIEF DESCRIPTION OF THE DRAWINGS

The invention may be further understood by reference to the following description taken in connection with the following drawings.

FIG. 14, consisting of FIGS. 14*a* and 14*b*,

FIG. 15, consisting of FIGS. 15*a*, 15*b* and 15*c*,

DETAILED DESCRIPTION OF THE INVENTION

Figure 1:
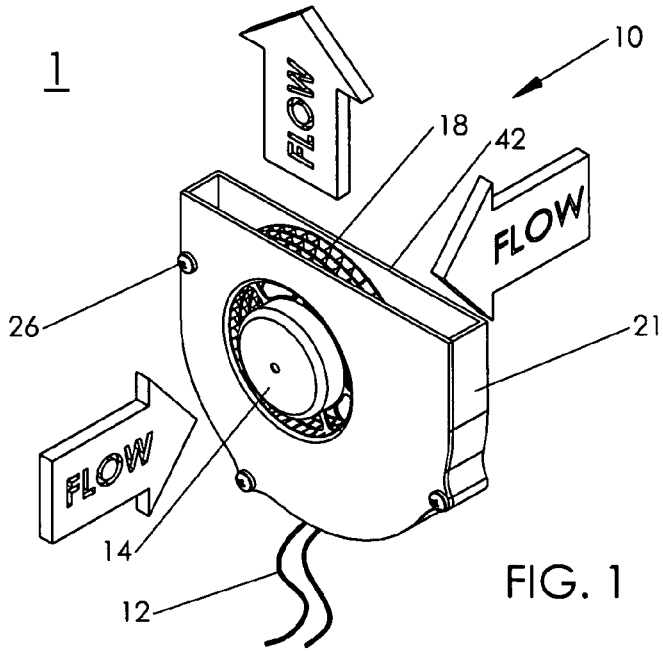
FIG. 1 is a perspective view of a radial blower constructed in accordance with an embodiment of the present invention.
Figure 2:
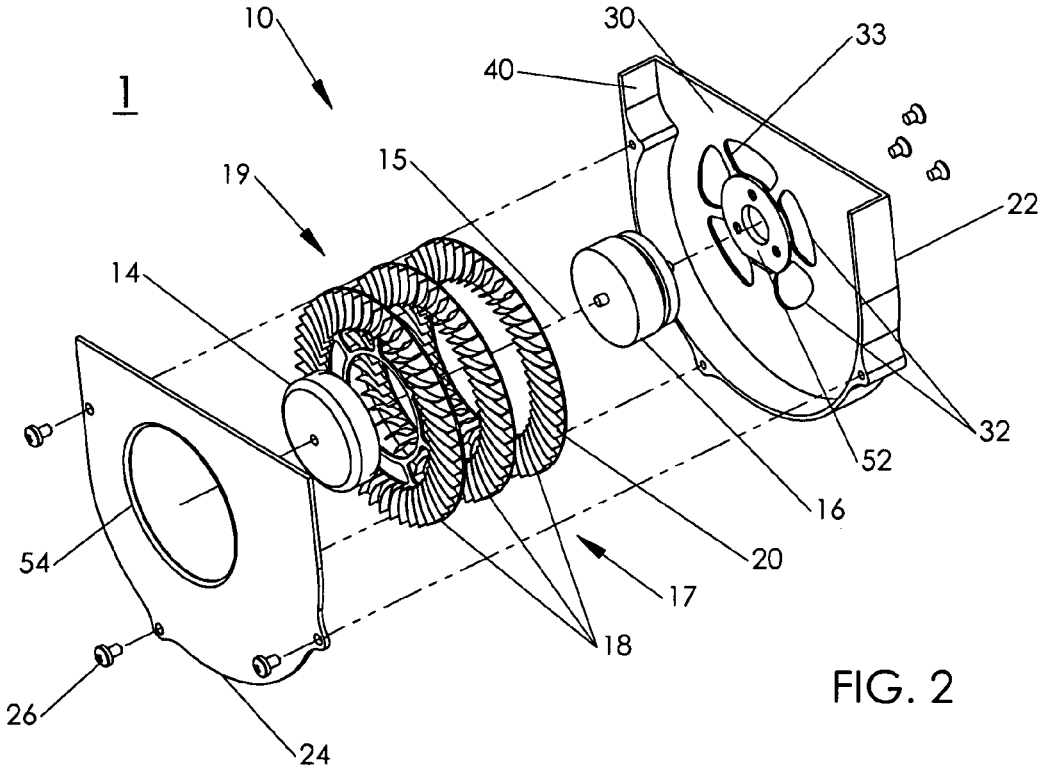
FIG. 2 is an axonometric exploded view of the radial blower of FIG. 1.

FIGS. 1 and 2 are respectively a perspective view and an exploded view of fluid momentum transfer device 1 comprising a radial fluid mover 10 constructed in accordance with an embodiment of the present invention. The fluid referred to with respect to FIGS. 1 and 2 is air. Air is a fluid which is commonly moved. However, the description of air movement comprises a description of movement of other fluids as well. While in the present illustration a momentum transfer device 1 is discussed which transfers momentum to fluid, embodiments could also be provided which transfer momentum from fluid. The momentum transfer device 1 could comprise a turbine in which momentum is transferred from air to a rotor. In FIG. 1, air flow direction is indicated by arrows. The radial blower 10 has a power line 12 which enters a housing 21. The housing 21 may conveniently be a square or rectangular housing or may closely follow a curved interior shape of an outlet fluid flow collector. The blower 10 is preferably a dc brushless machine with a permanent magnet "machine" rotor 14, a fluid mover rotor 18 and a motor assembly 16 coupled to the power line 12. The fluid mover rotor 18 is mounted concentrically around the motor rotor 14. The motor rotor 14 and the fluid mover rotor 18 have a common rotational axis 15 and together form a rotor assembly 17. However, the motor rotor 14 need not be of the permanent magnet type. The motor rotor 14 could be embodied in another type of dc motor, an ac motor or a non-electric motor. The fluid mover rotor 18 comprises passages 20 in a volumetric matrix 19 further described below.

In the present description, "machine" rotor is used to describe the polarized magnetic rotor hub to which moving magnetic fields are applied from the stator to cause rotation. "Fluid mover" rotor is used to describe the rotor portion that transfers momentum to fluid. The housing 21 is conveniently made in two parts. There is a rear housing section 22 and a front housing section 24. The terms front and rear are arbitrary, and are used to define relative orientation. The front housing section 24 is axially forward of the rear housing section 22. Axial orientation is with respect to the rotation of a rotor in the blower 10. The rear and front housing sections 22 and 24 are secured in a conventional manner by fasteners, e.g. screws, 26. "Upper" and "lower" are also arbitrary designations. They refer to opposite directions along an axis perpendicular to the axial direction.

As best seen with respect to FIG. 2, the rear housing section 22 in one form comprises a rear plate 30 having apertures 32 separated by radial support spokes 33. The apertures 32 define a fluid inlet having an annular envelope. Air enters the apertures 32 in an axial direction. In this embodiment, the rear housing section 22 comprises an axially extending wall 40. The wall 40 is curved in a conventional shape for a radial blower, and subtends approximately 270° around the rotation axis 15. The housing 21 comprises an open side 42. The open side 42 may be rectangular, and comprises a fluid outlet. A front housing section 24 closes the housing 21.

In one form, the rear plate 30 has a central section 52 radially inwardly of the apertures 32. The motor stator assembly 16 is supported to the central section 52. The motor stator assembly 16 includes known circuitry to provide moving magnetic fields to drive the motor rotor 14. The front housing section 24 has a central aperture 54 concentric with the rotor assembly 17. The central aperture 54 may also act as a fluid inlet.

In accordance with embodiments of the present invention, the fluid mover rotor 18 comprises the volumetric matrix 19 of fluid propelling passages 20 rather than blades. A cross-section of each passage 20 is constrained in size so that there is no opportunity to form a boundary layer that will separate from passage 20 surfaces. The passages 20 are sufficiently small in cross-section so that flow therethrough is laminar. A large number of passages 20 are provided. "Large" is in comparison to the number of blades or vanes in a prior art vaned rotor. Due to the cross-sectional constraints, each passage will subtend a small angle about the axis 15 (FIG. 2). The passages 20 are preferably packed to provide the maximum flow area for a rotor of a given circumference and axial height. The passages 20 may be embodied in many ways.

In this description of the instant invention we define the word normal to mean perpendicular to the mean centerline of a passage in the volumetric matrix making up a fluid mover rotor (or stator) at any given point along that passage. Because the passages are typically curved, the passage's normal plane is not necessarily aligned to the principal planes of the rotor (or stator).

Figure 3A:
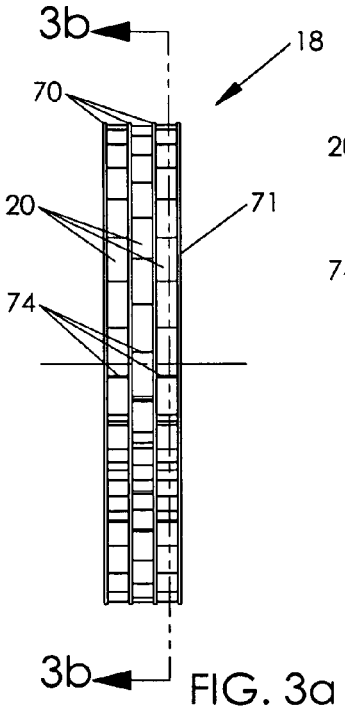
FIG. 3, consisting of FIGS. 3*a*, 3*b* and 3*c*, which are a side elevation, a sectional view and a partial detail view of the section shown in FIG. 3*b* illustrating design of fluid-impelling surfaces respectively, illustrates the rotor of FIG. 2.
Figure 3B:
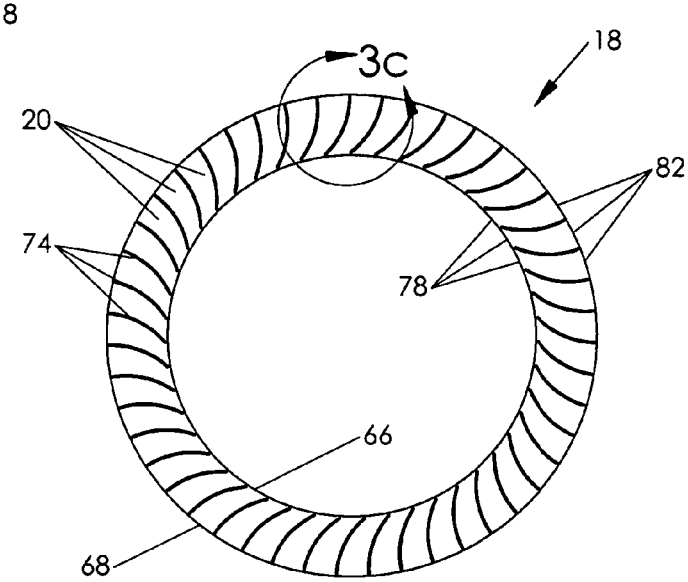
Figure 3C:
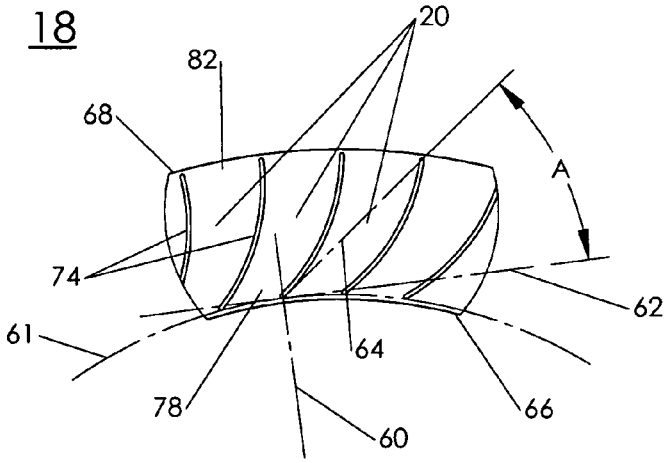
Figure 4:
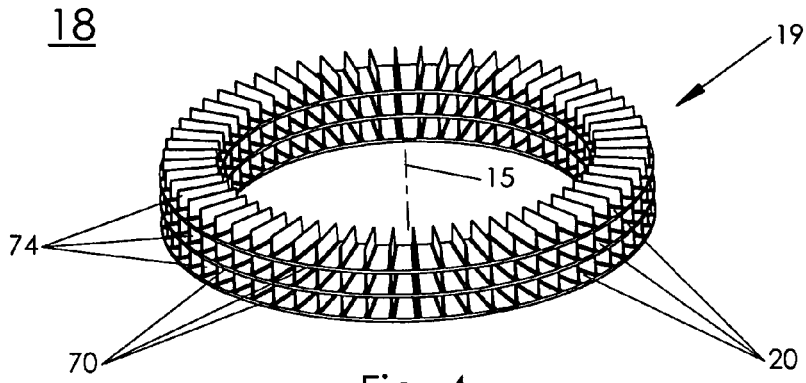
FIG. 4 is a perspective view of an alternate configuration of the rotor of FIG. 2.

One form of fluid mover rotor 18 is illustrated in FIGS. 3*a*, 3*b* and 3*c*, which are respectively a side elevation, a sectional view and a partial detail view of the section. FIG. 4 is a perspective view of an alternative form of fluid mover rotor 18. The fluid mover rotor 18 comprises one or more disks 70 with an inner diameter 66 and an outer diameter 68. The fluid mover rotor 18 comprises a matrix of adjacent passages 20. The passages 20 are defined by walls 74 projecting axially from the disk 70 and extending in a direction having a radial component. Each wall 74 is preferably perpendicular to the disk 70, but could be canted. If the disk 70 is molded, the walls 74 could have a draft angle, i.e., a taper in the axial direction. Then the walls 74 would have a central portion perpendicular to the disk 70 even if the surfaces of the wall 74 were slightly angled with respect to the direction perpendicular to the disk 70.

The walls 74 may extend the entire length from the inner diameter 66 to the outer diameter 68. Alternatively, the walls 74 could begin and end in the vicinity of the inner and outer diameters 66 and 68 respectively. Walls 74 may preferably be made thin to minimize blockage to air entering the inner diameter 66 of the fluid mover rotor 18. The width of the passage 20 at any diameter increases with radial distance from the inner diameter 66 to the outer diameter 68. In a preferred form, the passages have height to normal width ratio of about 1 near the radial position on the disk 70 having an average diameter. However, the normal cross-section of the passage 20 is constrained to provide laminar flow along its entire length. At the inner diameter 66, each passage 20 may subtend an equal angle, i.e., have the same angular width. In a further form, the passages 20 have varying angular widths. The preferred form is to have one or more annular disks 70 axially stacked as shown in FIG. 3*a* to meet the design flow requirement. The cover disk 71 is optionally attached to the walls 74 of the last annular disk 70 to enclose the passages 20. In practice it is not always necessary to use the cover disk 71 because of the close clearance to the inside surface of the radial blower housing. It is therefore not necessary for all of the passages in the rotor to be enclosed on all sides. In most preferable embodiments, the rotor comprises a matrix of enclosed passages and additionally a set of none or relatively few (compared to the number of passages in the matrix) unenclosed passages on the outer portions thereof. Whether or not a cover disk 71 is used, each layer defines an annular envelope having an inner diameter and an outer diameter.

The fluid mover rotor 18 preferably comprises a continuous matrix of passages 20, each having a small normal cross-section and being separated by the thin walls 74. "Small" is quantitatively determined in the following manner. The width (angular extent) and height (axial extent) of the passage 20 are dimensioned to force the flow through the entire length of the passage 20 to be laminar. The character of fluid flow through a channel is often characterized by a quantity known as the Reynolds Number:

$$N_R = VD/\nu = \rho VD/\mu \quad (1)$$

where ρ is fluid density, V is fluid velocity, D is a characteristic dimension, ν is kinematic viscosity and μ is absolute viscosity. The passage 20 can be designed to have a characteristic dimension D when the desired values for the other parameters of equation (1) are known or designated. Flow in an internal passage is characterized as laminar if $N_R<2300$; transitional if $2300<N_R<\sim4000$; and turbulent if $N_R>\sim4000$. Laminar flow is streamlined and smooth. Turbulent flow is agitated and vortex filled. Typical prior art air movers have turbulent flow conditions within the passages in which momentum is transferred with the air (around and between blades).

Laminar flow is present in boundary layers near solid surfaces. Turbulent flow exists where the boundary layer has separated from the blade surface and in the space between the blade boundary layers which are each attached to a blade surface. A preferred range of Reynolds number to obtain desirable flow characteristics is 1000 to 2000. Reynolds numbers above about 2300 are preferably avoided to prevent the development of turbulent flow. Reynolds numbers below about 200 are not considered useful for two reasons: first, the friction factor for internal laminar flow is $64/N_R$, so friction increases rapidly at Reynolds numbers below 200; secondly, at Reynolds numbers below about 200, the volumetric flow through the fluid mover rotor is quite low, and has fewer practical uses. The value of ν is known for a particular fluid at a particular temperature, and the value of V can be calculated from a desired volumetric flow rate Q and from one or both of an air inlet area and an air outlet area as V=Q/A, where A is the smaller of the air inlet area or air outlet area since the smaller area of the two determines the maximum velocity of the fluid through the passages. In one nominal embodiment, the passage 20 has a normal width (dimension between walls 74) of 1.5 mm at the inner diameter 66 and a width of 2.2 mm at the outer diameter 68. A nominal height (axial dimension) is 1.7 mm. The rectangle defining a normal cross-section of the passage 20 is defined by the height and the width. Since the passage is not circular, it does not have a true diameter. Therefore, a value of D suitable for use in equation (1) with respect to a rectangular passage may be calculated as the hydraulic diameter $D_h$, which has industry accepted values for a wide variety of cross sectional shapes. For a rectangular passage, $D_h$=(2×length×width)/(length+width). For advantageous embodiments, it has been found that passages with hydraulic diameters $D_h$ within a range selected in accordance with the following equation are advantageous:

$$200(A\nu/Q)<D_h<2300(A\nu/Q) \quad (2)$$

where A is the smaller of the open air inlet or open air outlet area and Q is at least one volumetric flow rate that is pre-selected, expected, or desired during operation of the fluid mover. It will be appreciated that fluid movers may have a variety of pre-selected or desired flow rates that may depend on sensed parameters during operation such as ambient temperature or power consumption considerations. The volumetric flow rate of the above equation is any flow rate that the fluid mover is intended to provide at any time during normal use. Although the above equation has been derived using the Reynolds number as one foundation, it will be appreciated that a variety of construction details of a given fluid mover will determine whether flow through the fluid mover is truly laminar at all locations within or around the fluid mover, and that embodiments of the invention need not guarantee laminar flow at all times or at all locations in and/or around the fluid mover. It is, however, expected that fluid movers produced with the dimensions and characteristics described herein will produce at least predominantly laminar flow. In some advantageous embodiments, completely laminar flow is present throughout the rotor, and this is generally considered the most advantageous situation.

The walls 74 may have a thickness of 0.13 mm, for example. This dimension can readily be provided when the annular disk 70 is made of machined aluminum. The annular disk 70 could also be made by molding plastic. Even thinner walls 74 may be provided when the wall 74 is made from foil or from sheet material such as plastic. The open area of a fluid mover rotor at a particular radius, r, is defined as the ratio of the sum of all passage area normal to a radial line to the total area of the rotor envelope ($2\pi rh$, where h is the height of the rotor). With this construction, the open area at the inner diameter 66, is e.g. 80%, and is available for entry of air. It has been found that improved performance is obtained when the open area is at least 70%. An aspect ratio, i.e., ratio of maximum dimension $D_{max}$ to minimum dimension $D_{min}$ of a cross section of a passage 20 normal to the direction of flow, of 1 will typically provide the greatest area of flow for a given perimeter. In this description of the instant invention we define the phrase maximum dimension of a passage, $D_{max}$, to mean the length of the longest straight line segment passing through the centroid of a figure created by a normal section through the passage, the line terminating at two opposite places on the periphery of the figure. Likewise, we define the phrase minimum dimension of a passage, $D_{min}$, to mean the length of the shortest straight line segment passing through the centroid of a figure created by a normal section through the passage, the line terminating at two opposite places on the periphery of the figure. Too high an aspect ratio also leads to difficulty in manufacture. A $D_{max}/D_{min}$ of about 1.0 to about 3.0 is preferable, with about 1.0 to about 2.25 being optimal. The same considerations apply to stator passages as well as rotor passages. It has also been found preferable if the passage length L is at least about 3 times the passage hydraulic diameter, $D_h$, and/or maximum dimension, $D_{max}$. With these aspect ratios, the maximum cross sectional dimension $D_{max}$ of the passages will typically be between $D_h$ and $2D_h$, depending on the specific shape. Accordingly, another set of formulas that are useful for defining advantageous flow passage dimensions are as follows:

$$1.0 \leq D_{max}/D_{min} \leq 3.0 \quad (3)$$

$$250(A\nu/Q)<D_{max}<5000(A\nu/Q) \quad (4)$$

where A, ν, and Q are as defined above.

Air entering the passage 20 initially has a uniform velocity across the area of the passage 20. In laminar flow, as air progresses through a passage of sufficient length, a parabolic velocity front develops. This is a well-known phenomenon related to the fluid drag between adjacent layers of fluid. Air in the center of the passage is farthest from the surface, and moves the fastest. At a position in the passage where a parabolic front has fully developed, average velocity of the air across the cross-section of the passage is half of the maximum velocity. The length required for the parabolic front to fully develop, i.e., the length required for a fully developed laminar flow velocity profile, is called the hydrodynamic entrance length $L_{hy}$. In accordance with an embodiment of the present invention, the length of the passage 20 is constrained to be less than the hydrodynamic entrance length. The hydrodynamic entrance length for a circular passage at Reynolds numbers above about 100 is given by:

$$L_{hy}=0.056D_hN_R, \quad (5)$$

where $D_h$ is the hydraulic diameter of the passage. (Reference: *Laminar Flow Forced Convection In Ducts, A Source Book for Compact Heat Exchanger Analytical Data*, R. K. Shah and A. L. London, Academic Press, New York, 1978, p. 99) In a further embodiment, in order to assure maximum flow rate, the length of the passage 20 is less than 20% of the hydrodynamic entrance length, $L_{hy}$.

In an embodiment in which a value of $N_R$ of 1,000 is selected and $D_h$ is 1.79 mm, $L_{hy}$ will be 100 mm. Blowers that are used, for example, in notebook computers will be significantly smaller than 100 mm in all of their dimensions. The length of passage 20 will be less than the radius of a fluid mover rotor 18. Consequently, the length of a passage 20 will be a small fraction of the hydrodynamic entrance length $L_{hy}$. Throughflow capacity of the fluid mover rotor 18 will be maximized because the parabolic velocity profile will not have the opportunity to develop. A relatively uniform and constant flow profile will be maintained in each passage 20.

It has been found that for small size cooling fans that are useful, for example, in laptop computers, advantageous efficiencies produced with the above described principles are obtained when the overall rotor diameter is less than 100 mm, the passages have a $D_{max}/D_{min}$ of 1.0 to 2.5, and a $D_{max}$ along the length of the passages of between 0.5 mm and 5 mm. Passage lengths in these embodiments are typically between 1.5 mm and 50 mm. In the portable electronic device environment, such a fan is typically positioned in the device to direct air toward electronic circuits and/or heat dissipating components thermally coupled to the electronic circuits. The fan is also typically powered by a battery that also powers the heat generating electronic circuits within the computer. Because battery life is of critical importance, efficient but small fans as described herein are advantageous in this environment.

The walls 74 may be straight and oriented radially on the fluid mover rotor 18 as shown in FIG. 4. Alternatively, the walls 74 may define passage inlet regions 78 that provide an entrance to the passage 20 that is sloped towards the direction of rotation, as seen in FIGS. 3*b* and 3*c* or FIGS. 5*b*, 5*d* and 5*f* below. An angled passage inlet region is also called an inducer. In the illustration of FIG. 3*c*, the walls 74 are curved, and a tangent line 64 to the wall at the inner radius of the wall (indicated by arc 61) is at an angle "A" to the tangent line 62 perpendicular to a radial line 60. Inducers, or passage inlet regions 78, facilitate entry of air into the passages 20 by minimizing the angle of attack with the walls 74. Ease of entry of air into the passages 20 minimizes inlet incidence losses. The approximate angle "A" of an inducer is determined by calculating the arctangent of the ratio of the radial fluid velocity to the tangential velocity of the fluid mover rotor 18 (both velocities being at the inner diameter 66 of the fluid mover rotor 18). At the outer diameter 68, passage outlet regions 82 comprise outer ends of the passages 20. There are three different exit configurations that may be provided. The exit direction may be substantially radial or backward leaning or forward leaning. The selection of exit direction is application specific to meet the total design performance requirements. FIG. 5 depicts how embodiments of the present invention adapt to radial, backward leaning and forward leaning configurations.

Figure 5A:
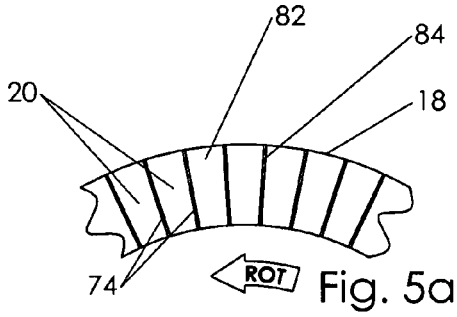
FIG. 5, consisting of FIGS. 5*a* through 5*f*, illustrates further forms of radial passages that may be used in a fluid mover rotor that may be used in the embodiment of FIG. 1.
Figure 5B:
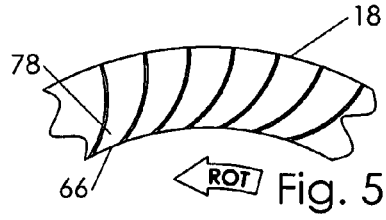
Figure 5C:
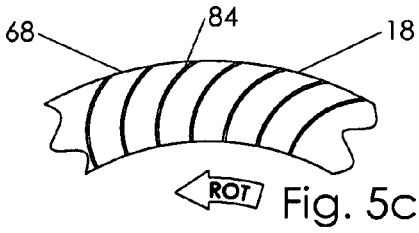
Figure 5D:
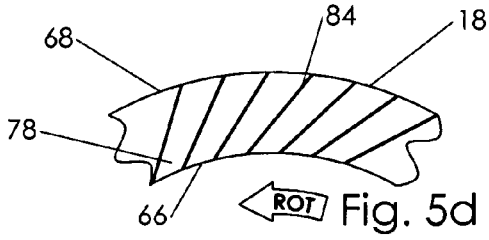
Figure 5E:
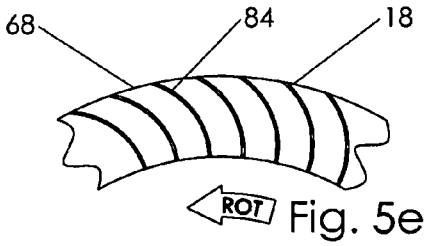
Figure 5F:
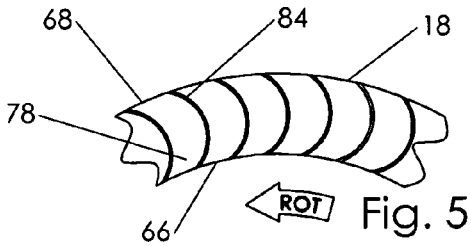

FIG. 5 consists of FIGS. 5*a*-5*f*, which are each a partial, detailed plan view of an outward radial flow fluid mover rotor 18. FIG. 5 illustrates alternate forms of passage 20. In each form, the passage 20 extends primarily in the radial direction. In the illustration of FIG. 5, the fluid mover rotor 18 is to be rotated in a counterclockwise direction as indicated by the arrow. The various embodiments of FIG. 5 will accommodate the full range of design performance requirements. In the embodiment of FIG. 5*a*, the walls 74 each extend along a radial line. In FIGS. 5*a*, 5*c* and 5*e*, the embodiments shown all have walls 74 near the inner diameter 66 that are radial. In other words, these three embodiments do not have inducers since their passage inlet regions 78 are aligned radially. In FIGS. 5*b*, 5*d* and 5*f*, each passage 20 includes an inducer since their passage inlet regions 78 are formed by walls 74 that slope in the direction of the fluid mover rotor's 18 rotation. In the case of FIGS. 5*b* and 5*f*, the passage inlet region 78 is formed between curved walls 74. In the case of FIG. 5*d*, the passage inlet region 78 is formed between straight walls 74. FIGS. 5*a* and 5*b* show embodiments of a fluid mover rotor 18 with a radial exit configuration as defined by the outer portions 84 of the walls 74. In the embodiments of FIGS. 5*c* and 5*d*, the outer portion 84 of each wall 74 adjacent the outer diameter 68 is backward leaning. In the embodiments of FIGS. 5*e* and 5*f*, the outer portion 84 of each wall 74 is forward leaning.

Figure 6A:
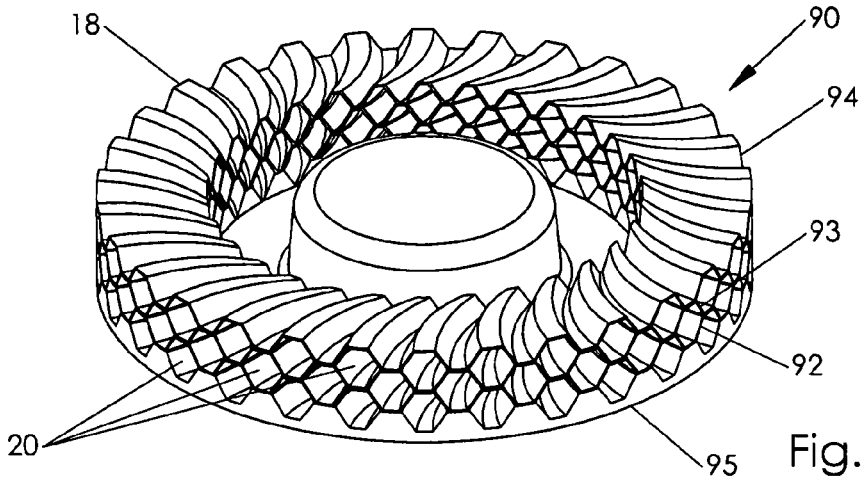
FIG. 6 consists of FIGS. 6*a* through 6*c*, which are respectively an upper, lower and cross-sectional perspective view of a fluid mover rotor comprising passages having other than a rectangular cross-section which "tile" or "pack"
Figure 6B:
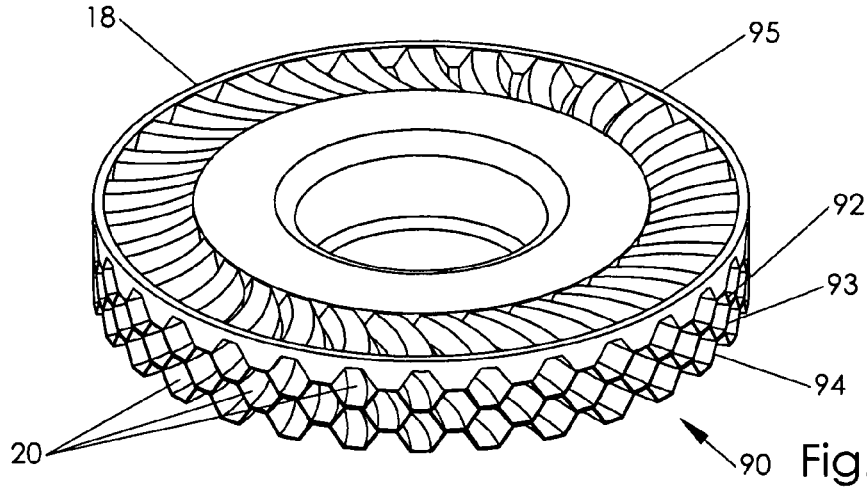
Figure 6C:
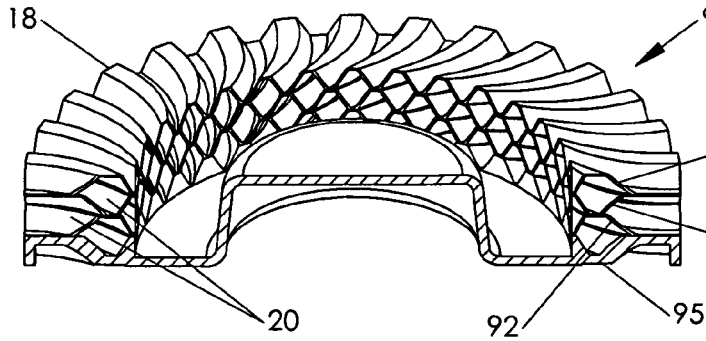

FIG. 6 consists of FIGS. 6*a* through 6*c*, which are respectively an upper, lower and cross-sectional perspective view of a fluid mover rotor 18 comprising passages 20 having other than a rectangular cross-section which "tile" or "pack". Up to this point in the disclosure, all examples of passage shape have been rectangular (including square), but other passage shapes are also possible. In the embodiment of FIG. 6, the fluid mover rotor 18 comprises a volumetric matrix 90, having a plurality of layers 92, 93 and 94 forming passages 20. The layer 92 is attached to a disk substrate 95 to form a first layer of passages 20. The disk substrate serves to connect the fluid mover rotor 18 to a means for coupling rotary motion to the rotor, such as a motor. As shown in FIG. 6, the disk substrate 95 could be of an injection molded construction while the layers 92, 93 and 94 may be made of thin film that is stamped or corrugated. Adjacent passages 20 in the volumetric matrix 90 share common walls. Each of the passages 20 is of a hexagonal cross-section. It is desirable to have a geometric cross-section that will "tile" or "pack," i.e., fill space without wasted volume. Other shapes that will pack include rectangles (including squares), triangles, trapezoids and hexagons. It is possible to construct the fluid mover rotor 18 out of cylindrical or conical tubes. However the spaces between adjoining circular cross-sections have cusps. If the cusps are filled, the total flow area is reduced; if the cusps are open, this shape tends to create greater drag on passing air since shapes with cusps have a proportion of surface perimeter to cross-sectional area that is greater than shapes without cusps.

Figure 7A:
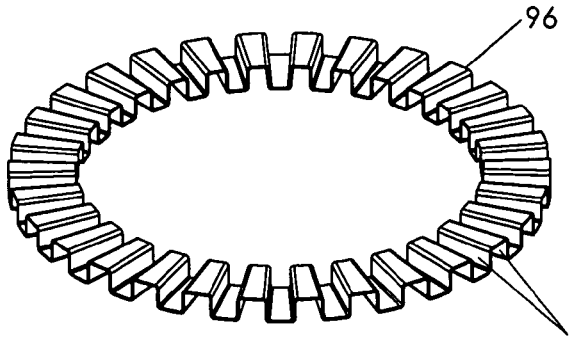
FIG. 7, consisting of FIGS. 7*a*-7*g*, comprises perspective views of alternative forms of fluid mover rotor structures.
Figure 7B:
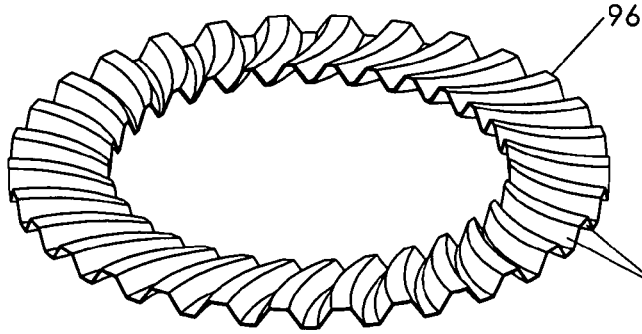
Figure 7C:
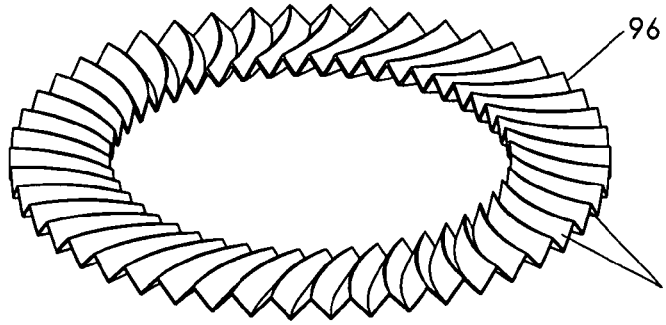
Figure 7D:
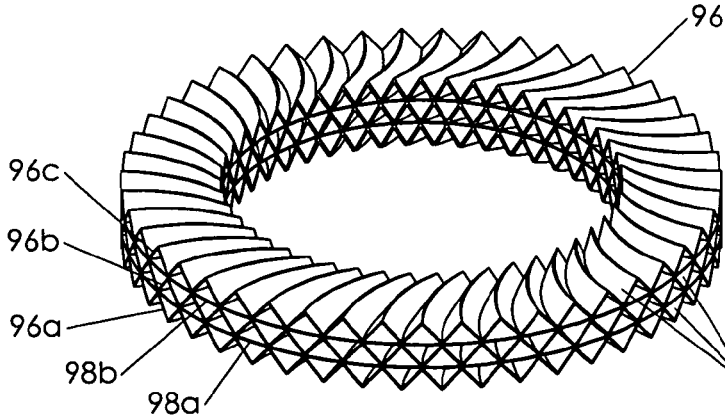

FIGS. 7*a*-7*d* comprise perspective views of alternative forms of fluid mover rotor structures. FIGS. 7*a*-7*c* each illustrate a fluid mover rotor structure 96 in which a substrate such as the disk 70 in FIG. 3 is not necessary. The rotor structure 96 comprises a corrugated annulus. The cross-sections of the corrugations may be identical within a rotor structure 96, with adjacent passages 20 comprising congruent polygons inverted with respect to one another. In FIGS. 7*a*, 7*b*, and 7*c*, the corrugations are respectively square, trapezoidal (creating hexagonal cells) and triangular. The passages 20 within each rotor structure 96 may be formed with any one of the dispositions illustrated in FIG. 5. The passages 20 in FIG. 7*a* lie along radii. The passages 20 of the embodiments of FIG. 7*b* and 7*c* are radial with an inlet inducer section. In the embodiment of FIG. 7*d*, three rotor structures 96*a*, 96*b* and 96*c* are stacked to provide a multilayer rotor. Any other integer number of rotor structures may be stacked. The multilayer rotor may further include annular disks 98 as intermediate adjacent layers. In the present illustration, the rotor structures 96*a* and 96*b* are mounted on opposite axial sides of a disk 98*a*. The rotor structures 96*b* and 96*c* are mounted on opposite axial sides of a disk 98*b*. The disks 98*a* and 98*b* serve to separate passages 20 as well as supporting the rotor structures 96.

Figure 7E:
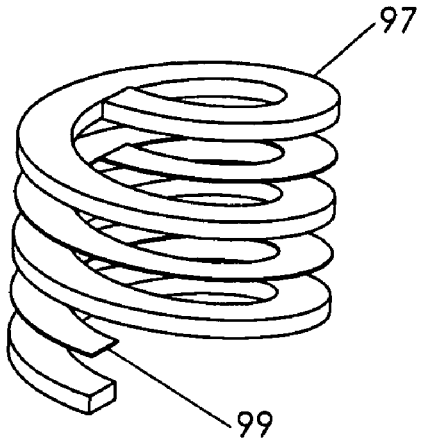
Figure 7F:
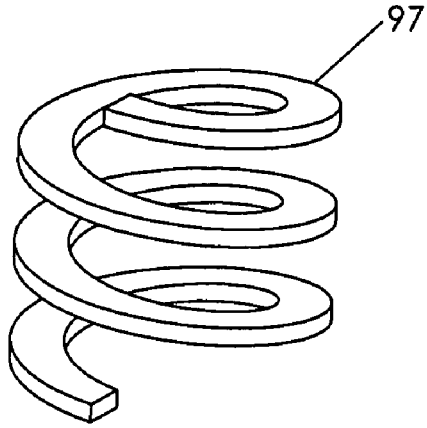
Figure 7G:
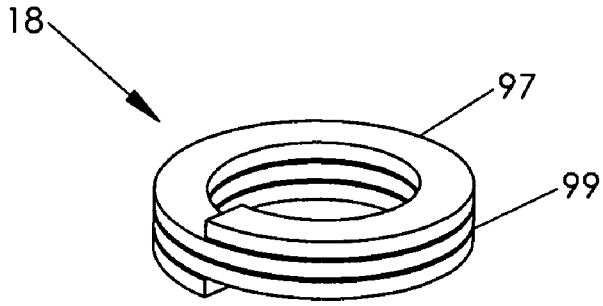

FIGS. 7*e* and 7*f* illustrate an alternative method of forming the radial fluid mover rotor 18. In FIG. 7*e*, a corrugated strip 97 is wound in a helical fashion about a central axis. An interposer 99 is arranged to follow a similar helical path between adjacent layers of the corrugated strip 97. The interposer 99 may serve to separate adjacent layers of the helically wound corrugated strip 97 and serve to form individual passages 20. The interposer 99 may be a double faced tape that unitizes the rotor structure 18. FIG. 7*f* shows an embodiment of a helically wound corrugated strip 97 without the presence of an interposing strip. In the illustrations of FIGS. 7*e* and 7*f*, the corrugated strip 97 has a length enabling it to be wound in a helix multiple layers deep. For clarity in FIGS. 7*e* and 7*f*, walls 74 are not shown on the corrugated strip 97. In FIG. 7*g*, the rotor 18 is shown compacted axially to its working height where the helical layers are in contact. For clarity in FIG. 7*g*, walls 74 are not shown on the helically wound corrugated strip 97.

Figure 8:
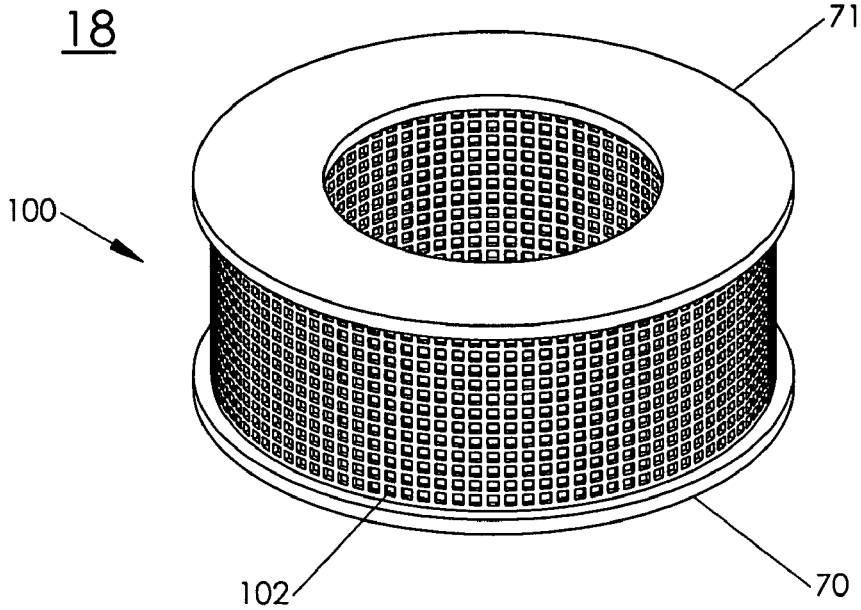
FIGS. 8 and 9 are axonometric illustrations of different forms of a fluid mover rotor comprising a porous solid.
Figure 9:
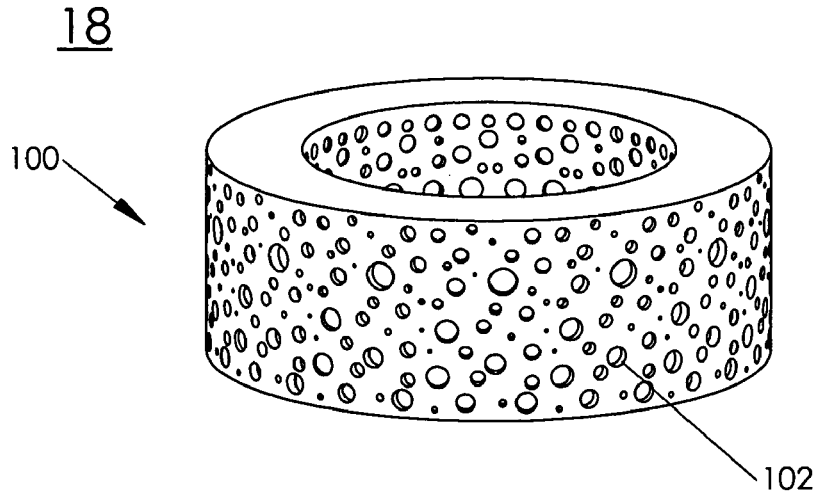

FIGS. 8 and 9 are axonometric illustrations of a fluid mover rotor 18 comprising a porous solid. In the embodiment of FIG. 8, a volumetric matrix 100 includes passages 102. The passages 102 are not discrete passages as in the embodiments of FIGS. 3-7. In the embodiment of FIG. 8, the volumetric matrix comprises a wire mesh wrapped in a spiral and supported between the disk 70 and a cover disk 71. Alternatively, the volumetric matrix 100 may comprise a porous solid or a reticulated open cell foam body, as illustrated in FIG. 9. In some embodiments, the volumetric matrix 100 may comprise particles or components packed so that spaces between the particles or components are continuous and small enough to force laminar flow. Preferably, the open area of a porous solid used as a fluid mover is greater than 50%.

Figure 10A:
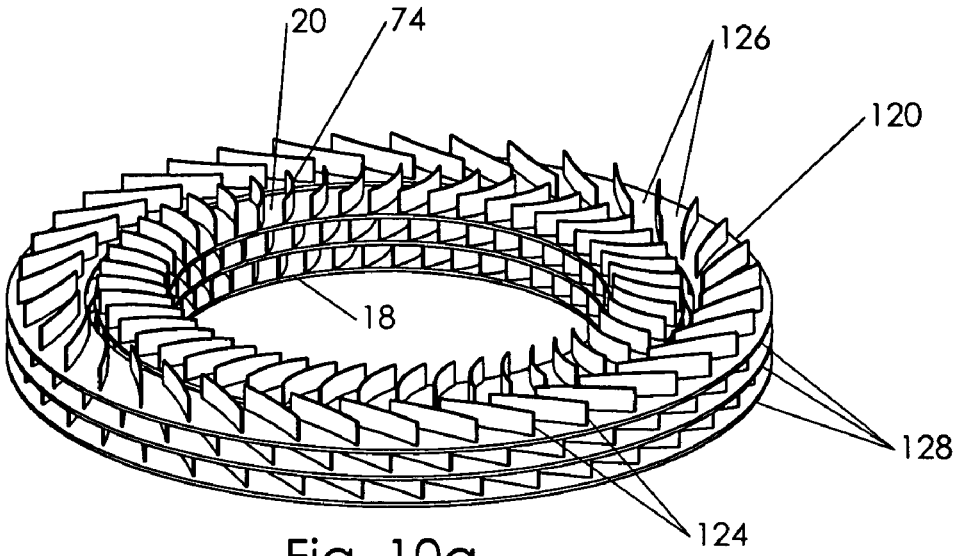
FIG. 10, consisting of FIGS. 10*a* and 10*b*, which are respectively a perspective view and a plan view, illustrates a stator structure which directs fluid flow exiting from a radial fluid mover rotor.
Figure 10B:
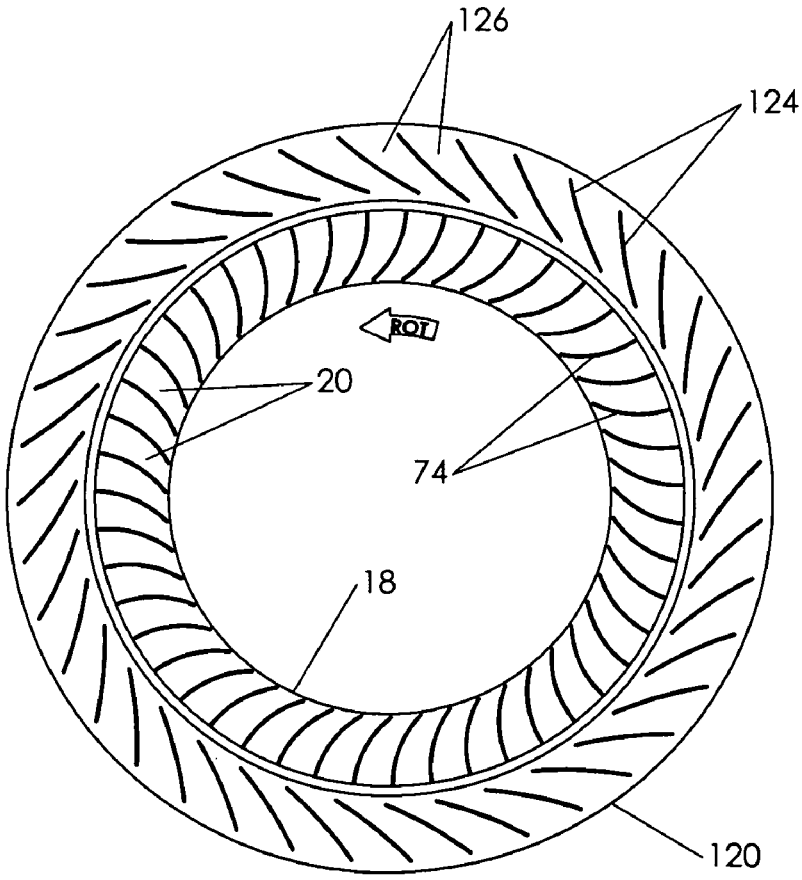

FIG. 10, consisting of FIGS. 10*a* and 10*b*, which are respectively a perspective view and a plan view, illustrates an outward radial flow stator structure which directs fluid flow exiting from a fluid mover rotor. In FIG. 10, a fluid mover rotor 18 is surrounded by a concentric stator assembly 120. The stator assembly 120 comprises a number of diffusing passages 126 that allow a controlled decrease in air flow velocity in a compact space and an attendant increase in static pressure in the air flow. Since the static pressure is increased, air mover efficiency increases for a given flow volume. The stator assembly 120 may be mounted inside the housing 21 (FIGS. 1 and 2). In the present illustration, the fluid mover rotor 18 rotates in a counterclockwise direction.

Diffusing passages 126 are each defined between a pair of adjacent walls 124 and annular disks 128. The diffusing passages 126 are dimensioned in the same manner as are the passages 20 in the fluid mover rotor 18 to constrain the moving fluid to laminar flow. The stationary matrix of diffusing passages 126 at the entry to the stator assembly 120 is oriented to receive the tangential flow from the rotor with minimum incidence loss. The diffusing passages 126 then turn the flow to a more radial direction at the exit of the stator assembly 120. The radial gap between the rotor 18 and stator assembly 120 is between about 2% and 20% of the rotor outer diameter to minimize flow disturbance and noise generation in the transfer of flow from the rotor to the diffuser. The inlets of diffusing passages 126 are angularly aligned with an exit velocity vector of the fluid exiting from the rotor 18 to further minimize flow disturbance.

Figure 11B:
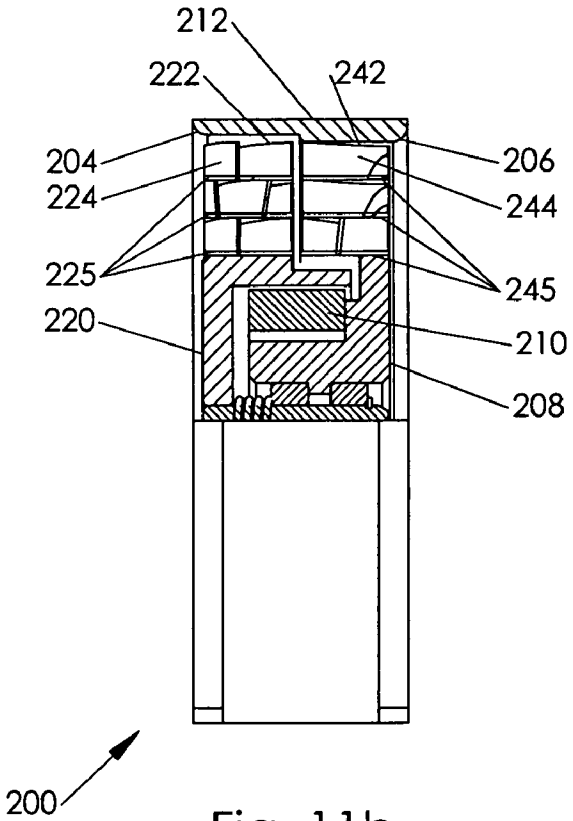
FIG. 11, consisting of FIGS. 11*a*, 11*b* and 11*c*, are respectively a front elevation, a side elevation, partially broken away, and an axonometric exploded view of an axial flow fluid mover constructed in accordance with an embodiment of the present invention.
Figure 11A:
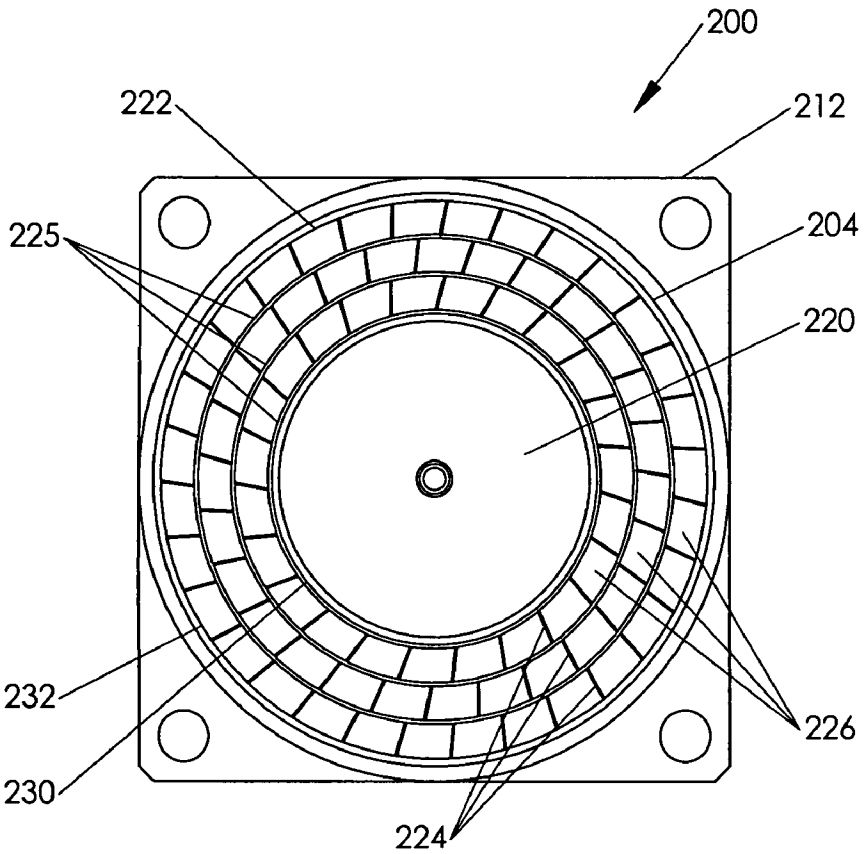
Figure 11C:
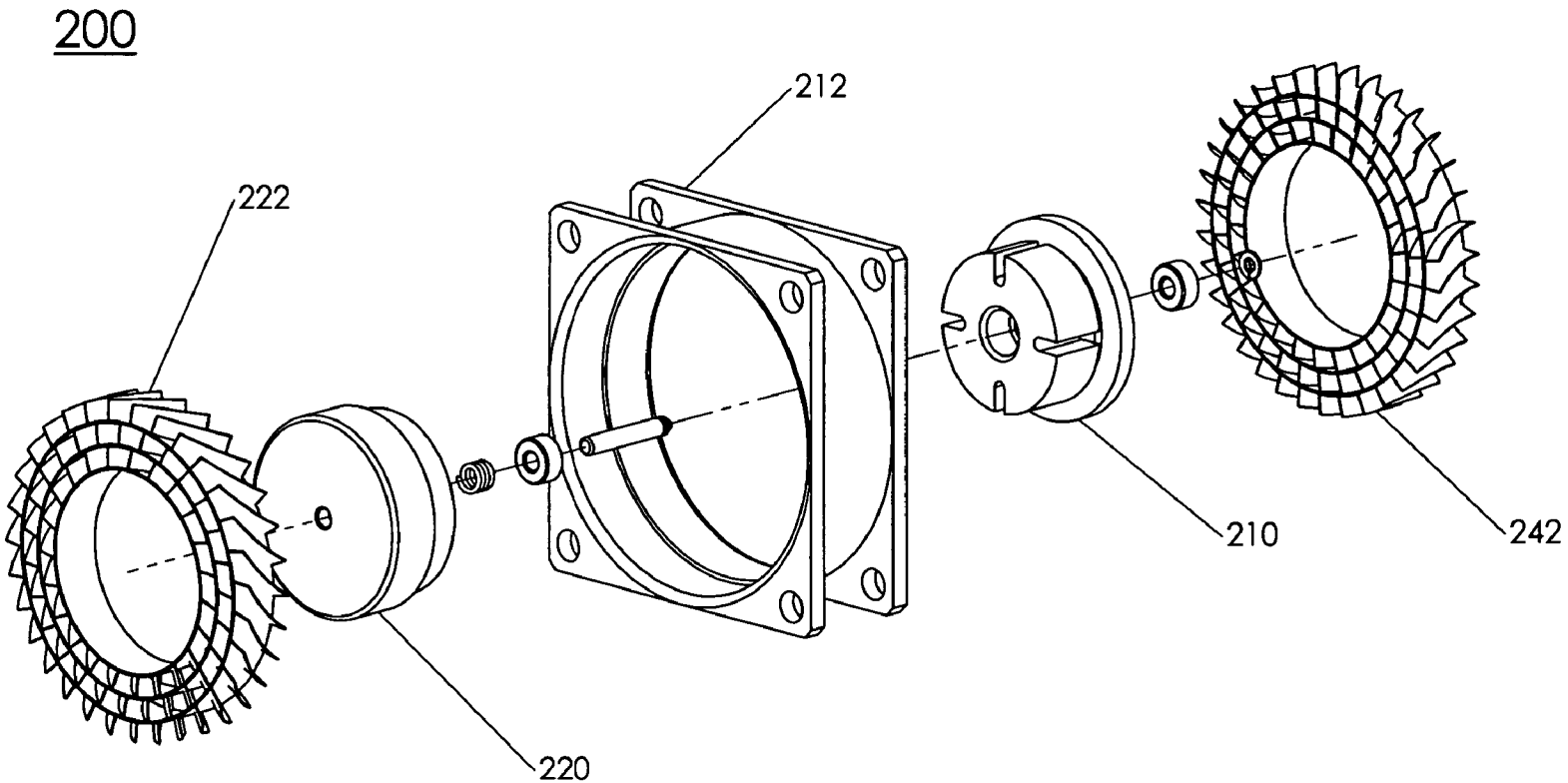

The considerations discussed above have also been applied in accordance with embodiments of the present invention to laminar flow fluid movers with axial flow. FIGS. 11*a*, 11*b* and 11*c* are respectively a front elevation, a side elevation, partially broken away, and an axonometric exploded view of an axial flow fluid mover 200 constructed in accordance with an embodiment of the present invention. A housing 212 may comprise a square or circular thermoplastic housing or other housing commonly used for axial flow fluid movers. The housing 212 has a circular inlet 204 and outlet 206. The fluid mover 200 includes a motor 208 having a stator assembly 210 which drives a machine rotor 220, shown in more detail in FIG. 12. The machine rotor 220 comprises a central hub supporting a concentrically mounted annular fluid mover rotor 222 having radially extending walls 224 and annular rings 225 defining axial flow fluid propelling passages 226 on the exterior thereof. The fluid mover rotor 222 has an inner diameter 230 and an outer diameter 232. A fluid mover stator 242 is positioned concentric with and downstream of the fluid mover rotor 222. The fluid mover stator 242, also shown in FIG. 13 in more detail, serves to increase the overall static pressure rise by converting tangential exit whirl induced in the fluid by the fluid mover rotor 222 into purely axial leaving velocity. The fluid mover stator 242 also serves as a support structure connecting the motor 208 to the housing 212. The fluid mover stator 242 has radially extending walls 244 and annular rings 245 defining axial flow fluid diffusing passages 246 (see FIG. 13) on the exterior thereof. Where the motor 208 is a brushless dc machine, the machine motor 220 will comprise a permanent magnet rotor. However, other types of motors may be used. The motor 208 could comprise another type of dc motor, an ac motor or a non-electric motor.

It should be noted that the axial flow fluid mover depicted in FIG. 11 does not necessarily require the presence of the fluid mover stator 242 to function. The stator may be replaced by simple struts to connect the motor 208 to the housing 212.

Figure 12A:
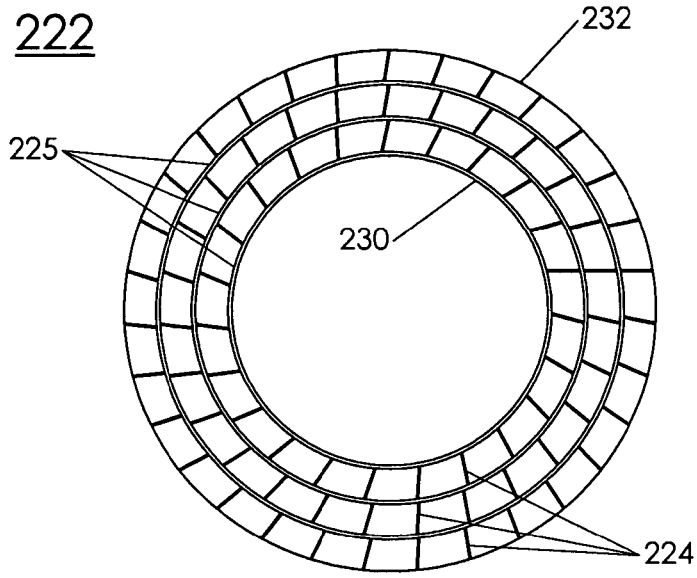
FIG. 12 is an illustration of a first form of rotor for an axial flow fluid mover, consisting of FIGS. 12*a* and 12*b*, which are respectively a front elevation and a perspective view
Figure 12B:
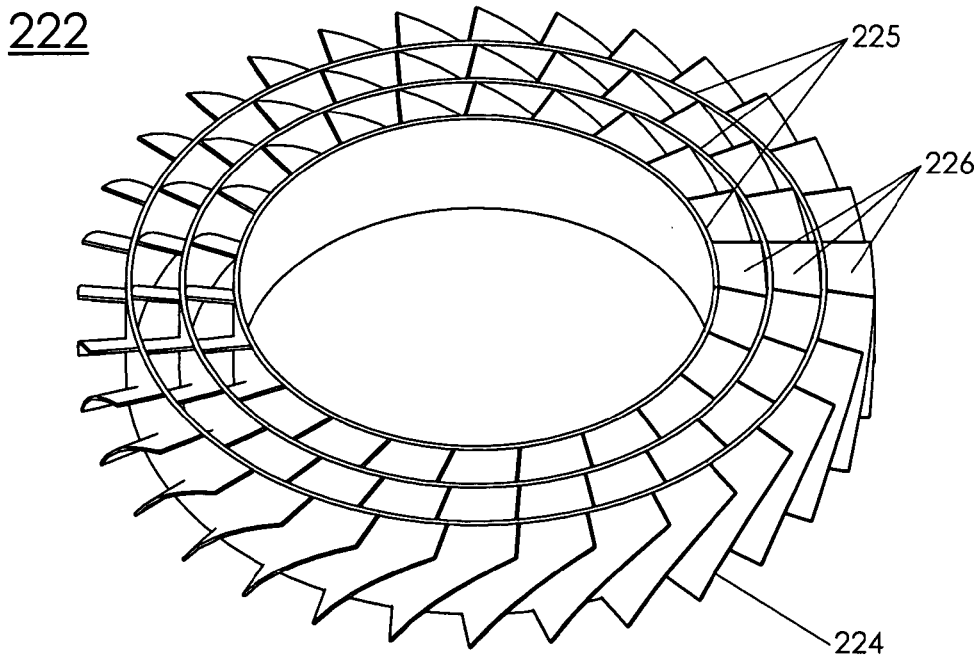

FIG. 12 is an illustration of a first form of rotor 222 for use in the axial flow fluid mover 200. The walls 224 may comprise curved walls extending in the radial direction from the annular rings 225. As in the case of the radial flow blower, dimensions of passages 226 are selected to force laminar flow. Equation (1) above may be used to select an effective passage characteristic dimension D based on normal passage width and radial height in view of a desired Reynolds Number $N_R$ and fluid velocity. In one nominal embodiment, the walls may be 0.13 mm thick. The normal passage width (between walls 224) is nominally 1.7 mm. The radial spacing between the annular rings 225 is nominally 1.7 mm leading to a normal passage cross-section that is nominally square. As in the case of the radial blower embodiment, the majority of the axial fluid mover rotor 222 comprises open space. The ratio of passage open area to frontal area is over 90%.

Figure 13A:
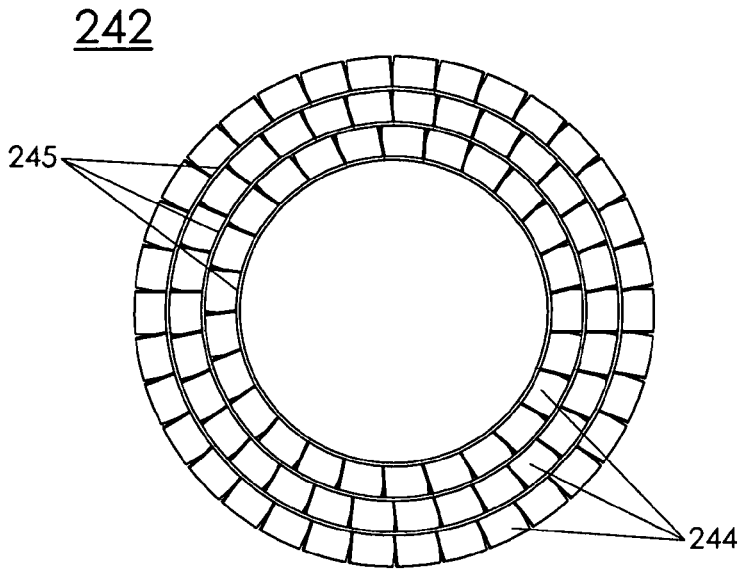
FIG. 13 is an illustration of a first form of stator for an axial flow fluid mover, consisting of FIGS. 13*a* and 13*b*, which are respectively a front elevation and a perspective view.
Figure 13B:
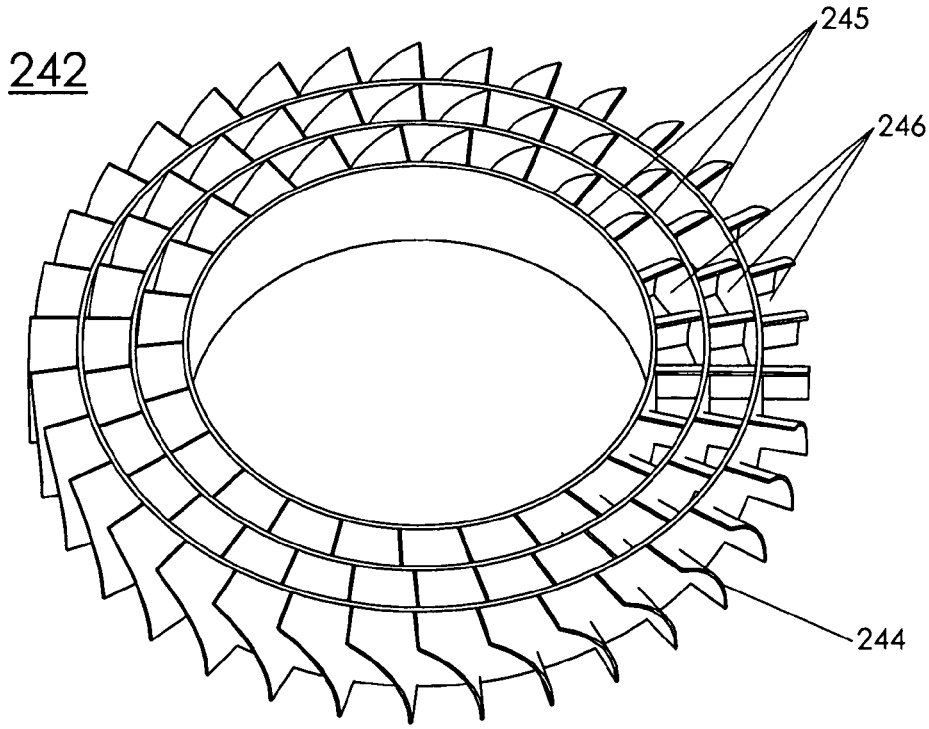

FIG. 13 is an illustration of a first form of stator 242 for use in the axial flow fluid mover 200 in conjunction with the rotor 222. The stator 242 does not move and remains fixed relative to the housing 212. The stator 242 is structurally similar to the rotor 222 in that it comprises walls 244 and annular rings 245 that together form passages 246. The stator passages 246 guide the fluid flow through them so that it leaves the axial flow fluid mover 200 with substantially no tangential velocity component.

Axial flow fans, blowers and turbine flow passages are usually designed from velocity diagrams based on absolute and relative flow vectors at rotor or stator inlet and outlet locations. For axial flow machines the velocity diagrams and passage profiles are most conveniently established in a circumferential section developed (unrolled) into a flat plane at the radius of interest.

Conventional, bladed axial flow turbomachinery is commonly designed for a constant axial velocity component from inlet to outlet at all radii. To accommodate the varying blade tangential velocity component at all radii, the blade profiles vary with radius and the entire blade appears as a twisted, geometrical form about a radial stacking line.

In the new, axial flow, laminar flow turbomachinery described herein each of the radial circumferential layers may be configured with different geometry to fit the local velocity profiles. This matches and optimizes the laminar passage matrix to the desired velocity profiles as does twisting of the blade sections in conventional axial flow turbomachinery.

In one form, the axial fluid mover rotor 222 may be made out of separate layers. FIGS. 14 and 15 are views of further ways of embodying walls 224 and annular rings 225 (as shown in FIG. 12) of an axial flow rotor in separate layers. In another form, the axial fluid mover rotor 222 may be made of a single strip wound in a spiral fashion. FIGS. 16 and 17 illustrate ways in which the axial fluid mover rotor 222 may be provided in a form for wrapping around the machine rotor 220. The axial fluid mover stator 242 can be formed in the same ways as the axial fluid mover rotor 222 disclosed here.

FIG. 14 consists of FIGS. 14*a* and 14*b*, which are respectively a plan view and an elevation of an axial fluid mover rotor 222 comprising a band 250. The band 250 comprises a substrate for walls 224. The band 250 and walls 224 may be molded in a unitary body of a plastic which is sufficiently flexible to be bent around the machine rotor 220 yet sufficiently rigid so that the walls 224 maintain their form. At one circumferential end of the band 250, keys 254 may be provided to fit in mating slots 256 at an opposite end of the band 250. When the band 250 is assembled to the machine rotor 220, the keys 254 may be locked in the slots 256 to maintain the axial fluid mover rotor 222 in place. Additional bands 250 may be assembled over a first band 250, with each successive band 250 having an increasing circumference to provide an inner diameter that will fit around a last layer of walls 224 and create passages 226. The passages 226 have a fluid entrance 236 and a fluid outlet 238.

FIG. 15, consisting of FIGS. 15*a*-15*c*, illustrates another way of embodying the passages 226. The passages 226 may be made from a corrugated strip 260 which may most conveniently be made in a regular, repeating pattern. The reference numeral 260 is used to refer collectively to corrugated strips 260*a*-260*c*, respectively illustrated in FIGS. 15*a*, 15*b* and 15*c*. A substrate layer 262 may be provided to support each corrugated strip 260 and close out the passages 226 formed by the strip. In FIG. 15*a*, the corrugated strip 260*a* has a repeating triangular pattern with each triangle being inverted with respect to the next. In FIG. 15*b*, the corrugated strip 260*b* has a repeating square pattern. In FIG. 15*c*, the corrugated strip 260*c* has a repeating trapezoidal pattern with each trapezoid being inverted with respect to the next to form a matrix of half hexagonal cells. Note that the passages created in the corrugated strip 260 are curved as shown in previous figures. In FIG. 15*c* the substrate layer 262 is optionally not used in order to place the corrugated strip directly on top of another strip to form complete hexagonal passages 226. For alignment of the hexagonal passages 226, subsequent corrugated strips 260*c* will need a larger pitch between the trapezoidal patterns; alternately, a substrate layer 262 can be placed between pairs of the corrugated strip 260*c*. The corrugated strips 260 may be made of foil or other thin material to provide minimal blockage to air entering the axial fluid mover rotor 222. One approach to using the corrugated strips 260 and substrate layers 262 is to cut them to lengths that wrap in a single layer around the machine rotor 220 and subsequent layers. The strips can be secured in place by adhesive bonding or other techniques. The substrate layer 262 can itself be made of tape with an adhesive coating on both sides. An axial fluid mover rotor 222 that appears like that of FIG. 12 can be obtained by this method of construction.

Figure 16A:
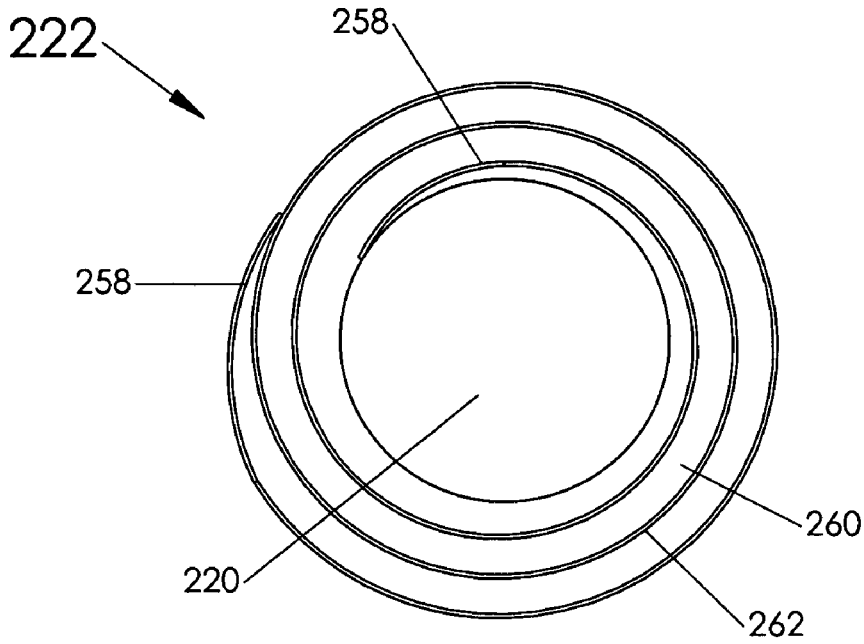
FIG. 16 consisting of FIGS. 16*a* and 16*b*.
Figure 16B:
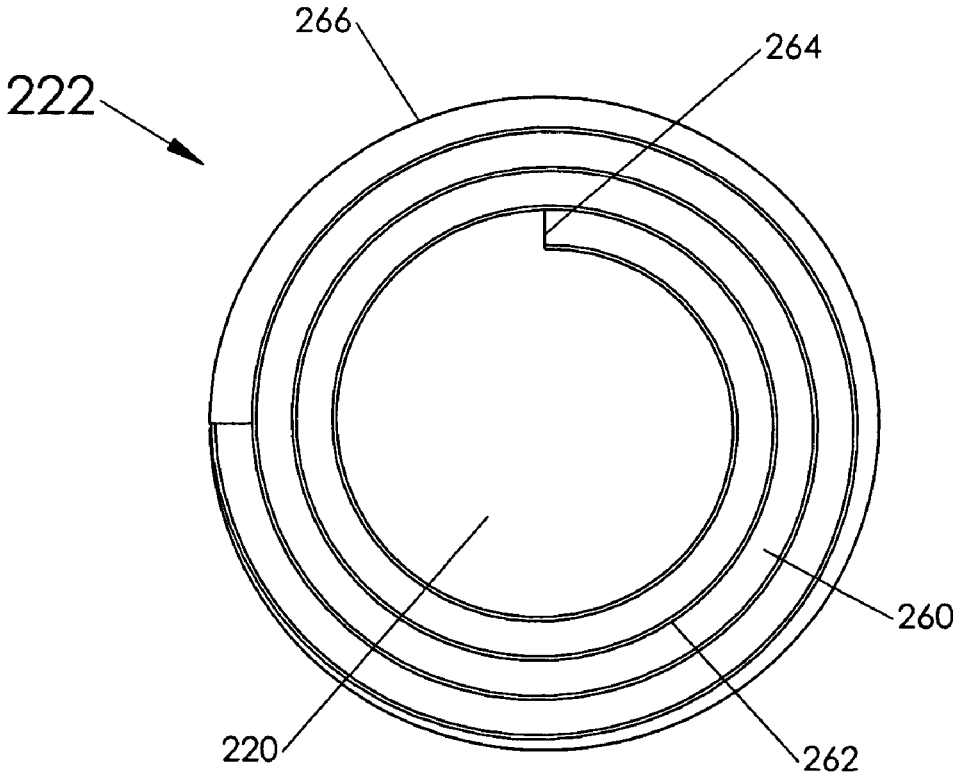

FIG. 16 illustrates two alternative methods of forming the axial fluid mover rotor 222 around the machine rotor 220. The corrugated strip 260 and the substrate layer 262 may have a length of several times that of the circumference of the machine rotor 220. In the illustrations of FIG. 16, the corrugated strip 260 and the substrate layer 262 have a length enabling them to be wrapped around the machine rotor 220 in a spiral multiple layers deep. To accommodate the radial step at the beginning and end of the spiral winding two alternate approaches are shown. In FIG. 16*a*, the thickness of the corrugated strip 260 may be tapered at each end to allow a smooth transition at the beginning and end of the spiral. Tapered end sections 258, at each end of the corrugated strip 260 allow the axial fluid mover rotor 222 to be approximately circular. For clarity in FIG. 16*a*, walls 224 are not shown on the corrugated strip 260. Alternately, as shown in FIG. 16*b*, the machine rotor 220 may be formed with a notch 264 to accommodate the beginning of the winding and an outer shroud 266 could be placed on the axial fluid mover rotor 222 with an internal notch to accommodate the end of the spiral winding of the constant thickness corrugated strip 260. For clarity in FIG. 16*b*, walls 224 are not shown on the corrugated strip 260.

Figure 17A:
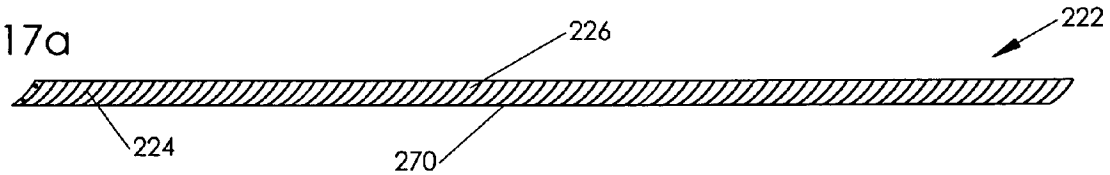
FIG. 17 consisting of FIGS. 17*a*, 17*b* and 17*c*, are views of further forms of axial flow fluid mover rotors.
Figure 17B:
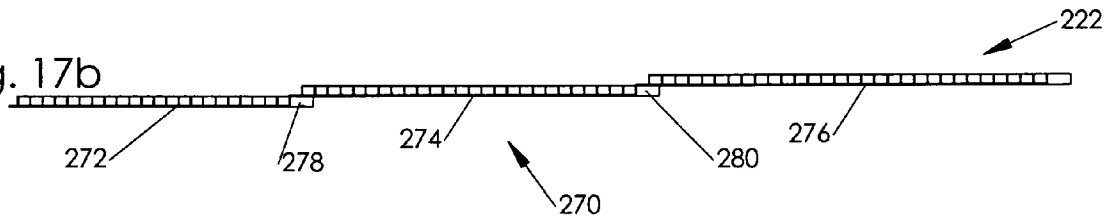
Figure 17C:
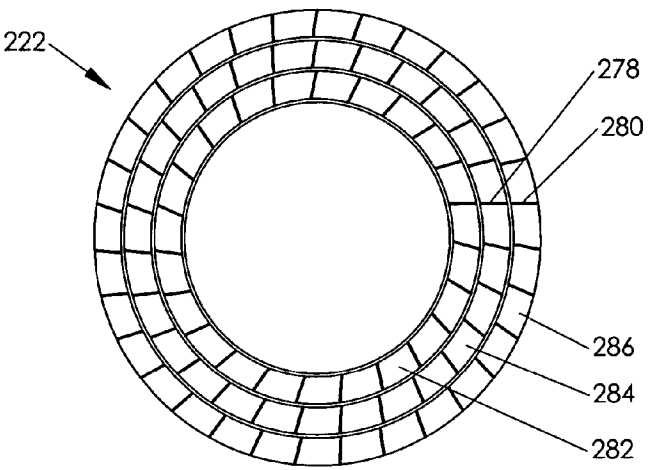

In the embodiment of FIGS. 17*a*, 17*b* and 17*c*, the fluid mover rotor 222 is comprised of a long strip which is wrapped around the machine rotor 220 to form concentric circular layers. FIG. 17*a* is a plan view of a strip with walls 224 forming passages 226. FIG. 17*b* is a side elevation of the strip in FIG. 17*a*. As seen in FIG. 17*b*, a stepped base 270 is provided on the strip. The stepped base may correspond to the band 250 of FIG. 14. The illustration of FIG. 17*b* provides for three layers 282, 284 and 286 (FIG. 17*c*). First, second and third adjacent sections 272, 274 and 276 each have a length corresponding to a circumference of a successive layer. Sections 272 and 274 are connected by a step 278. Sections 274 and 276 are connected by a step 280. The height of each step corresponds to the height of the layer terminating in that step. FIG. 17*c* illustrates the stepped base wrapped around the machine rotor 220 to form the concentric layers 282, 284 and 286.

As described above, passage geometry in the laminar flow air movers is carefully controlled to force the establishment and maintenance of laminar flow. Unexpected advantages have been obtained utilizing embodiments of the present invention which are further described with respect to the graph presented in FIG. 18. The prior art has not recognized the advantages of maintaining laminar flow in all regions of fan and blower rotors (and stators if so equipped).

Figure 18:
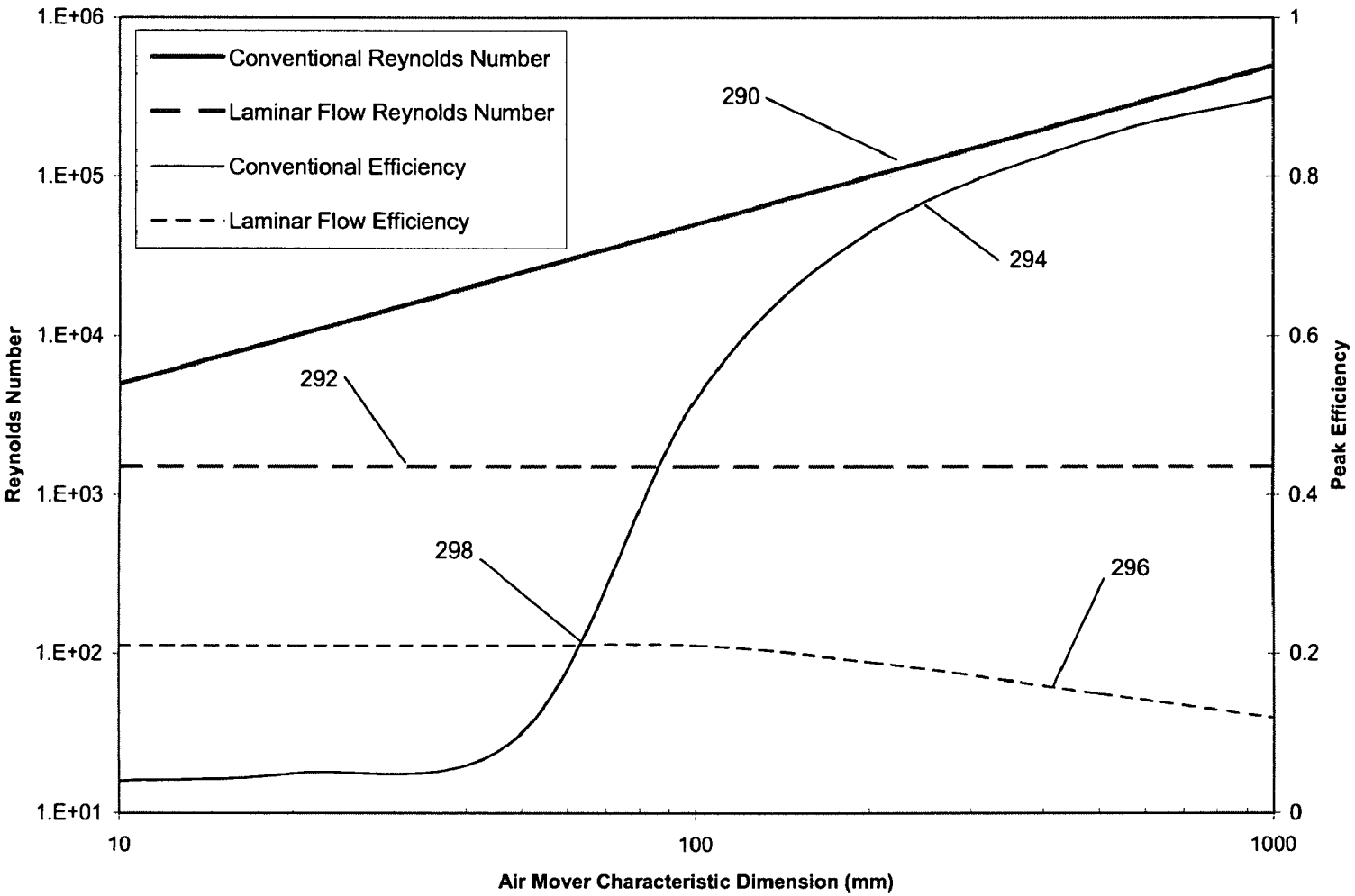
FIG. 18 is a chart showing comparisons of Reynolds Number and peak efficiency in laminar flow air movers and conventional turbomachinery.

FIG. 18 is a graphical comparison of the Reynolds Number and peak efficiency of the laminar flow air mover and air movers based on conventional turbomachinery designs. This graphical representation is for illustrative purposes and is not based on actual measurements. Along the horizontal axis, the air mover characteristic dimension is plotted. The characteristic dimension in this case is the maximum diameter of the air mover rotor. The Reynolds Number of internal flow in the air mover rotor is plotted along the left hand vertical axis. The Reynolds Number is calculated using the air mover rotor's internal flow velocity and the hydraulic diameter of the rotor's internal passages. The line 290 represents the functional relationship between Reynolds Number and characteristic dimension for an air mover based on conventional turbomachine design. As the scale of a conventional air mover is reduced, Reynolds Number in its internal passages also drops. The line 292 represents the Reynolds Number in the internal passages of a laminar flow air mover. In contrast to the conventional air mover, the laminar flow air mover Reynolds Number is constant (by design) over the full range of characteristic dimension. FIG. 18 also shows the peak efficiency of each type of air mover as a function of characteristic dimension. The curve labeled 294 represents the peak efficiency obtainable with conventional turbomachine designs. Efficiencies over 80% are routinely obtained from large-scale machines. However, as scale is reduced, the efficiency of conventional turbomachinery designs quickly falls. The curve 296 represents the peak efficiency obtainable with laminar flow air mover designs. The efficiency is nearly constant over the full range of characteristic dimension. The crossover point 298 is where the efficiency of conventional turbomachine designs is equal to the efficiency of the laminar flow air mover design. At characteristic dimensions smaller than those at the crossover point, laminar flow air movers operate more efficiently. The characteristic dimension at the cross-over point is estimated to be in the range of 50 mm to 100 mm, thus it is advantageous to construct embodiments of the invention with rotors having diameters less than 100 mm, or more preferably less than 50 mm. Useful rotor diameters in laminar flow air movers according to embodiments of the present invention may include a range of diameters from 1 mm to 500 mm.

Air movers based on conventional turbomachinery designs suffer from severe scale down effects. Scale down effects include reduced efficiency in terms of flow work, i.e., the product of pressure and volume, versus input power. Increased flow blockage may also result if the circumferential thickness of air mover elements in the air inlet path cannot be scaled down in the same proportion as other elements. There is a limit as to how much the thickness of such elements may be reduced. Relatively thick elements occupying a greater proportion of circumference of an inner diameter through which air must flow will block air flow to a greater extent than in the version that is not scaled down. The crossover point at which laminar flow air movers exceed the efficiency of conventional turbomachinery is at a level well above the flow levels required for the applications described above. The range of air flow over which it is preferred to use embodiments of the present invention is in the range at which laminar flow fluid movers are significantly more efficient than fluid movers based on conventional turbomachine design.

In the air flow range of interest for small air movers, efficiency of laminar flow air movers is better than conventional fans and blowers as suggested by FIG. 18. Improved efficiency has several useful results in small air mover designs. Improved efficiency allows for reduced power consumption which can be important in devices such as laptop computers that operate from batteries. On the aggregate, with billions of computers operating in the world, even small efficiency improvements in cooling fans can amount to megawatt-hour energy savings. Improved efficiency can allow reduction in motor size and hence motor cost. Improved efficiency allows higher flow work output with a given motor. Improved efficiency can allow the use of quieter or less expensive bearings with higher friction. Improved efficiency will result in less power drawn from a power supply inside the device containing the small air mover. The reduced output power requirement on the power supply can allow its cost, size and heat rejection to be reduced.

Design and fabrication of the rotors and stators used in laminar flow air movers is simpler than in conventional turbomachinery because the precise thickness distribution of airfoil shapes is not required. The thickness of walls that form passages in laminar flow rotors and stators have no particular requirement for precision or exact consistency from one to another. In laminar flow rotors and stators, walls are used only to define the passages. Variations in wall thickness have no effect other than making small changes to passage flow area. Variation in wall thickness of a factor of 2 or more has little impact on the performance of a laminar flow rotor or stator. However, in conventional turbomachinery, variations on the order of only a few percent in local airfoil thickness can severely degrade performance.

Prototypes of the laminar flow air mover have been tested and shown to follow the fan laws accurately. Scaling to new design points can be done reliably and without computational fluid dynamic (CFD) analysis normally undertaken on new conventional-bladed air mover designs. Design features, such as inducer angle, have broad optimum ranges that generally result in successful designs without extensive iterative design and test cycles.

Laminar flow air movers have a number of advantages compared to conventional air movers when acoustic noise output is considered. It is often the goal of a particular design to minimize acoustic noise emissions at a certain volume flow and head. Because the efficiency of the laminar flow air mover is higher, less energy is dissipated as acoustic noise while more energy is directed to useful output (flow work). Because the laminar flow air mover has multiple passages, usually by a factor of 5 to 10 times more than the number of blades in conventional rotors of similar diameter, the blade pass frequency (BPF) will be 5 to 10 times higher. The BPF is often the dominant tone emitted by an air mover. When the BPF is higher, as with a laminar flow air mover, it may be in a frequency range in which human hearing is less sensitive. Also, higher frequencies are easier to block and absorb with acoustic treatments because of their shorter wavelength. The laminar flow air mover offers another approach to reducing the impact of the BPF. By making the size of individual passages in the volumetric matrix unequal in size (i.e., the spacing between walls is not equiangular), the BPF will not be a pure tone. Instead the acoustic emissions from the passing of individual passages will be spread over a range of frequencies, thus decreasing the concentration of acoustic energy at a particular frequency and reducing the annoyance value of the sound. Besides making individual passages of unequal size on a particular layer of the laminar flow air mover, adjoining layers may be offset angularly by a small amount so that passages on adjoining layers are not in line. Additionally, it is helpful to select the number of passages per layer to be a prime number. In this way, it is impossible for harmonics of the BPF to reinforce. It is also desirable, although not required, to have the number of passages on adjoining layers be of different numbers so that no harmonics may be reinforced.

The self-reinforcing matrix nature of many of the laminar flow rotors (both radial and axial flow) described above has the benefit of making them extremely rigid structures with high internal damping. Compared to typical bladed rotors of conventional turbomachinery the laminar flow rotor is much stiffer resulting in considerably higher structural resonance frequencies. This has a number of advantages for the present invention. Laminar flow rotors will be less likely to have resonances at audible frequencies and hence audible noise will be reduced. Laminar flow rotors will be less likely to have fatigue failures because of reduced vibration amplitude. The layered construction of laminar flow rotors has high inherent damping because of the presence of the interface between layers. This internal damping further reduces the likelihood of a structural resonance.

The surface finish of components in contact with moving fluid (wetted parts) in conventional turbomachinery is generally required to be very good. Smooth surfaces are required to reduce fluid drag and to avoid the premature separation of boundary layers. In conventional turbomachinery wetted parts, such as airfoil surfaces, in stators or rotors must be made with sufficiently low roughness to avoid degrading performance by more than a preselected level. This attention to surface finish of all wetted parts adds cost to the components of a conventional turbomachine The surface finish requirements also preclude the use of some materials and methods of manufacture because they would result in finishes with too much roughness. We have found that typical average surface roughness ($R_a$) values employed in conventional fans and blowers used for electronic cooling applications range from 8 to 32 microinches (0.2 to 0.8 microns). Because the present invention operates in the laminar flow regime at all times and points within its rotors and stators, surface finish concerns are eliminated altogether. In laminar flow, surface roughness has no effect on fluid drag (as stated earlier, the friction factor in internal laminar flow is a function of Reynolds number only). In laminar flow there is also no possibility of boundary layer separation. In embodiments of the present invention, surfaces of wetted parts may have high roughness, such as $R_a$=500 microinches (12.5 micron) or more. Typically, manufacturing methods described herein and not requiring special finishing as used in the prior art, can produce average surface roughness values of 63 to 250 microinches (1.6 to 6.3 microns).

By way of example, the following laminar flow air mover device has been constructed and tested. The device has a radial flow path and is similar to the device illustrated in FIGS. 1, 2 and 3. The housing is 60 mm×70 mm×10 mm. The rotor has an outside diameter of 48 mm and is made up of three stacked layers. Each layer has 47 passages resulting in a total of 141 passages in the matrix of the rotor. At the inner diameter, the normal passage width is 1.4 mm; at the outer diameter, the normal passage width is 3.0 mm. Passage height is 2.0 mm. The design flow for this air mover is $1.9\times10^{-3}$ $m^3/s$. Using an average passage cross-sectional area of 4.4 $mm^2$ results in an average air velocity of 3.1 m/s in the passages. The hydraulic diameter of the passage is 2.1 mm (based on the average passage width). The Reynolds Number is then 426 given that the kinematic viscosity of air at 20° C. is $1.51\times10^{-5}$ $m^2/s$. The flow regime in the passages of the air mover rotor is clearly laminar at this velocity (and total volumetric flow rate) and would remain laminar up to total volumetric flows of around $1\times10^{-2}$ $m^3/s$ ($N_R\approx2300$). The rotor passages have a curved inlet as shown in FIG. 3*c*. The inducer angle, indicated as angle A in FIG. 3*c*, is 35°. The passage outlets are radial. The rotor is constructed of three layers that are adhesive bonded together. The walls are 0.13 mm thick and are integral with the annular disks that are 0.25 mm thick.

Figure 19:
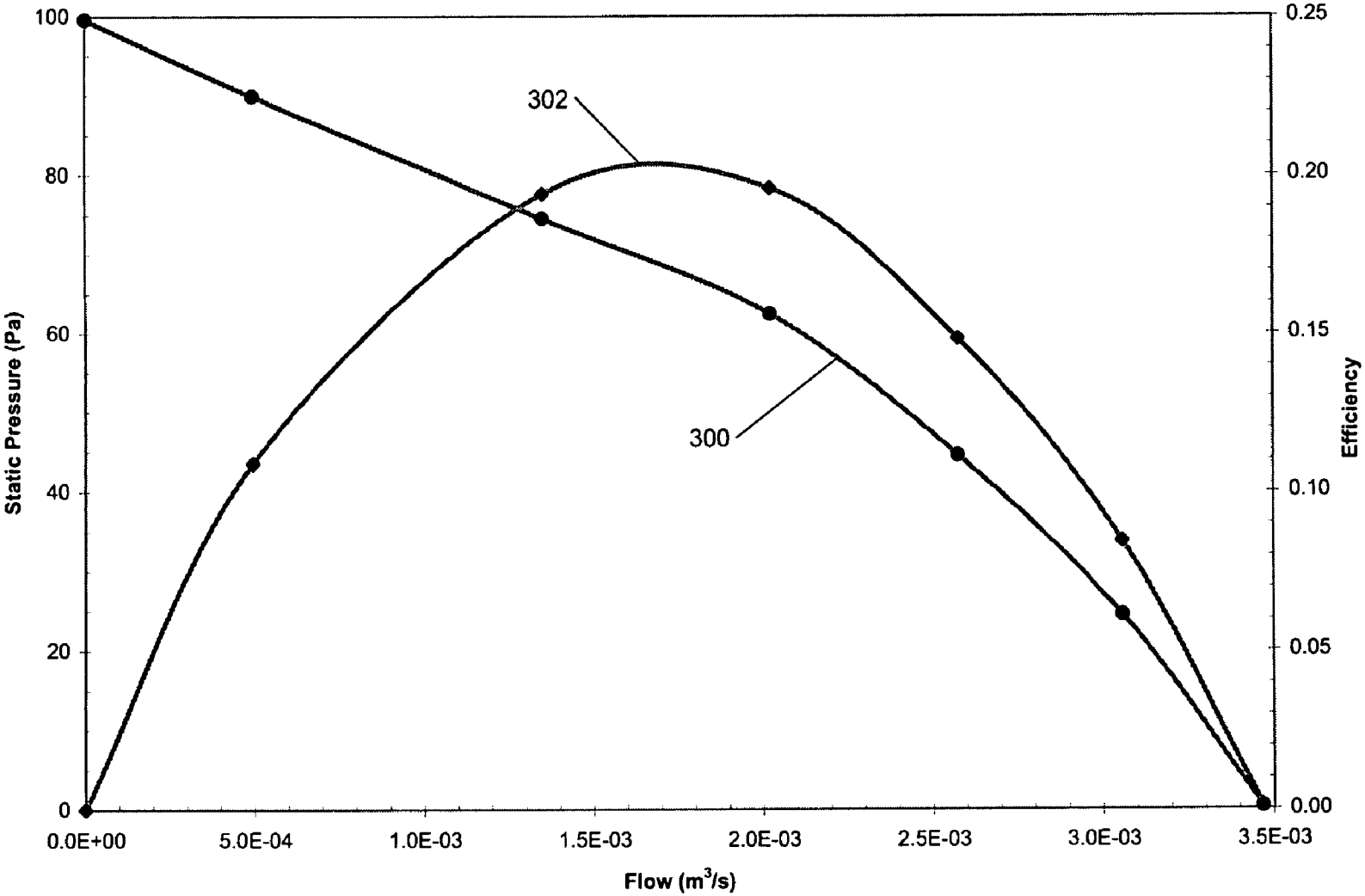
FIG. 19 is a chart showing the measured performance of a laminar flow air mover.

FIG. 19 is a graph on which the performance of the air mover is plotted. Data is shown for a constant rotational speed of 5,000 RPM. The horizontal axis represents volumetric flow in units of $m^3/s$. The left hand vertical axis represents static pressure in units of pascals (Pa). The right hand vertical axis represents efficiency which is non-dimensional. The first plotted curve, indicated as 300, is the P-Q curve. The line 300 represents the static pressure output of the air mover at corresponding flow rates. The second plotted curve, indicated as 302, is the efficiency of the air mover. Efficiency is defined as the ratio of useful work output to input work. The useful work output is the product of flow and static pressure. The input work in this case is defined as the electrical input power to the motor turning the rotor. Efficiency could also be calculated based on shaft power provided to the rotor. Efficiency falls to zero at the free delivery flow since static pressure is zero and at the shut-off point since delivered flow is zero. Apparent from the graph in FIG. 19, peak efficiency of the air mover device is about 20% and occurs at a flow of about $1.7\times10^{-3}$ $m^3/s$. From our study of conventional air mover devices of this scale, peak efficiencies based on electrical input power of about 5-12% are the best that can be expected.

In earlier descriptions of particular embodiments of the present invention, methods of manufacture of the various fluid mover rotors and stators (both radial and axial) have been briefly mentioned. Rotors and stators may be made up of stacked layers or may be made complete in one step (monolithic). If rotors or stators are made from stacked layers then there must be a subsequent step to assemble the layers into a complete rotor or stator.

Three distinct categories of manufacturing processes can be used for making the rotor or stator component, either monolithically or in layers. These methods are additive methods, forming methods and subtractive methods. These are discussed below.

Additive Methods:

1. Molding. Probably the most promising approach is to mold rotor or stator layers by plastic injection molding (PIM). It is also possible to use PIM to mold a monolithic rotor or stator if removable cores are used. These cores could be soluble or even melted out. The cores could also be mechanically actuated in the mold. PIM is known to be able to produce the very thin wall thicknesses we desire (~0.13 mm). Other types of molding processes could also be used such as zinc die casting. Ceramic or metal injection molding may also be used. Ceramic and metal injection molding require a post-cure step that drives off binders. During this step, layered parts may be stacked into complete rotors or stators. The post-cure process would then result in complete, monolithic parts.
2. Electroforming. Metal is plated onto a form. Wall thickness can be controlled exactly.
3. Metal Spray, Chemical Vapor Deposition (CVD), etc. These processes deposit a thin layer of material on a form.

Forming Methods:

4. Impact Extrusion. A metal or plastic blank is forced to fill a die cavity by a sharp impact. Very thin wall features can be created at high production rates by this well-established process.
5. Stamping. Metal or plastic blanks (washer-like disks) are formed in a die to give radial corrugations. Flat disks are interposed with the stamped disks to form layers of the rotor or stator. Various forms can be stamped such as triangular, rectangular, half-hexagonal or curved (such as a sine wave). The corrugations need not be strictly radial; inducer angles and backward or forward leaning passages can be produced as well. Alternately, instead of stamping a complete disk at once, straight strip can be feed into corrugating rollers to give a corrugated and curved strip. This strip can then be wound helically into a complete rotor or stator or cut into shorter pieces to give layers. This process is equally well suited to making corrugated strips to form axial flow rotors and stators via a spiral winding technique.

Subtractive Methods:

6. Etching. A blank of material can be made into the required shape by selectively removing material in an etching process. Either electrochemical machining or photochemical machining processes can be used. Components produced can be individual rotor or stator layers or complete, monolithic rotors or stators.
7. Machining. Conventional or electrical discharge machining (EDM) can be used to remove material from a blank (metal or plastic). Parts produced by these methods would be individual rotor or stator layers that would be assembled in a subsequent step.
8. Micro Fabrication Methods. For laminar flow rotors or stators of very small scale, the methods used in the production of semiconductors and micro-electro-mechanical systems (MEMS) devices are well suited to making rotor or stator layers or even complete monolithic rotors or stators.

As described above, a number of embodiments comprise components that must be stacked in layers and assembled into a monolithic rotor or stator. Three suitable approaches, which may be adapted to high volume assembly are adhesive bonding, welding and mechanical assembly. Each is discussed below in turn.

Adhesive Bonding:

(Applicable to All Material Types Unless Otherwise Noted)

1. Light-cured adhesives (best for clear plastic components).
2. Pressure sensitive adhesives (PSA) in tape or film form.
3. Heat cured adhesives such as epoxy.
4. Instant cure adhesives, e.g., cyanoacrylate sold under different trademarks, including Super Glue.

Welding:

(Metals Only Unless Otherwise Noted)

5. Ultrasonic welding (applicable to plastics and metals).
6. Heat staking (applicable to thermoplastics).
7. Resistance or projection welding.
8. Laser or E-beam welding.
9. Soldering or brazing (filler metal can be pre-applied to sheet material prior to forming or can be plated onto any fabricated part).
10. Diffusion bonding or sintering.

Mechanical Assembly:

11. Assembly with threaded fasteners (screws) or rivets.
12. Press or shrink fitting.
13. Tabs bent or deformed to lock layers in place.
14. Lacing of fine wire or thread around stacked parts.
15. Crimping or forming of a flange all around to hold layers together.

Embodiments of the present invention not only provide for improved efficiency, but also allow for simplification in manufacturing. Design and fabrication of the rotors and stators used in laminar flow air movers is simpler than in conventional turbomachinery because the precise thickness distribution of airfoil shapes is not required. The thickness of walls that form passages in laminar flow rotors and stators have no particular requirement for precision or exact consistency from one to another. Furthermore, the benefits of turbomachinery in accordance with the principles described above for use in portable and/or battery powered devices has not been appreciated. Increases in efficiency of operation provided by such designs allow for effective cooling with small fans having a diameter less than about 100 mm or preferably less than about 50 mm while minimizing power drain on the battery.

Embodiments of the invention can be varied in many ways. Such variations are not to be regarded as a departure from the spirit and scope of the invention, and all such modifications are intended to be within the scope of the invention.

What is claimed is:

1. A device for transferring momentum to a fluid comprising:

a cylindrical rotor having a largest dimension of less than 100 mm and axial length less than radial diameter; wherein said rotor defines a fluid inlet area $A_1$ and a fluid outlet area $A_2$, wherein $A_1$ and $A_2$ are both equal to or less than 5000 $mm^2$, said rotor comprising a defined array of radially or axially stacked passages formed in said rotor for transferring momentum into the fluid as said fluid passes through said passages in response to rotation of said rotor, said passages having a maximum cross sectional dimension of between 0.5 and 5 mm and an aspect ratio of between 1:1 and 1:3; and a motor configured to drive said rotor to cause fluid to flow through said passages at a flow rate characterized by a Reynolds number of between 200 and 2300.

2. A device according to claim 1, wherein said passages comprise a plurality of substantially parallel passages.

3. A device according to claim 1, wherein said rotor comprises an annular form receiving fluid input at an inner diameter thereof and wherein said passages provide a path in a radial direction from said inner diameter to an outer diameter of said rotor.

4. A device according to claim 1, wherein said rotor defines a substantially cylindrical envelope receiving fluid input at a first major surface thereof and wherein said passages provide a path in an axial direction from said first major surface to a second major surface of said rotor.

5. A device according to claim 1, wherein said passages are equiangularly spaced and wherein said rotor comprises a plurality of adjacent sets of passages.

6. A device according to claim 5, wherein said rotor comprises a central hub and an outer member wrapped around said hub and comprising said passages.

7. A device according to claim 1, additionally comprising a concentrically mounted stator assembly, wherein said stator assembly is formed with passages having dimensions to establish and maintain laminar flow of said fluid along the entire length of said passages when said rotor is operating at a pre-selected volumetric flow rate.

8. A device according to claim 1, wherein said passages have a surface roughness of greater than 1.6 microns.

9. A device according to claim 1 having passages formed by walls having a range in thickness of as low as 25% of a nominal thickness to as high as 300% of a nominal thickness.

10. A device according to claim 1, wherein selected passages subtend unequal angles about an inner diameter of said cylindrical rotor.

11. A device according to claim 1, wherein said rotor comprises a plurality of layers.

12. A device according to claim 11, wherein each layer comprises a prime number of passages.

13. A device according to claim 12, wherein passages in one layer are angularly displaced with respect to the passages in an adjacent layer.

14. A device according to claim 11, wherein a number of passages in one layer is not factorable by a same group of numbers by which at least one other layer is factorable.

15. A device according to claim 11, wherein at least two different layers have different passage geometry.

16. A device according to claim 1, wherein said passages each have a ratio of maximum cross sectional dimension to minimum cross sectional dimension of about 1.0 to 1.5.

17. A device according to claim 1, wherein said passages have flow lengths less than the length required for a fully developed laminar flow velocity profile.

18. A device according to claim 17 wherein said passages have flow lengths less than 20% of the length required for a fully developed laminar flow velocity profile.

19. A device according to claim 1, wherein said rotor has an open area of at least 70% at an air inlet surface.

20. A device according to claim 1, wherein passage dimensions are selected to provide passage flow areas that result in flow characterized by a Reynolds Number in the range of 1000 to 2000 at a preselected flow rate.

21. A device according to claim 1 wherein said passages have cross sections which pack.

22. A device according to claim 1, wherein most or all of said passages are completely enclosed.

* * * * *